US010937405B1

(12) United States Patent
Frahm

(10) Patent No.: US 10,937,405 B1
(45) Date of Patent: Mar. 2, 2021

(54) FOLDABLE PIANO KEYBOARD

(71) Applicant: Lindley Frahm, Redwood City, CA (US)

(72) Inventor: Lindley Frahm, Redwood City, CA (US)

( * ) Notice: Subject to any disclaimer, the term of this patent is extended or adjusted under 35 U.S.C. 154(b) by 0 days.

(21) Appl. No.: 16/872,315

(22) Filed: May 11, 2020

(51) Int. Cl.
*G10H 1/34* (2006.01)
*H01R 13/73* (2006.01)

(52) U.S. Cl.
CPC ..... *G10H 1/344* (2013.01); *H01R 13/73* (2013.01); *G10H 2220/256* (2013.01)

(58) Field of Classification Search
CPC ... G10H 1/344; G10H 2220/256; H01R 13/73
USPC ..... 84/644
See application file for complete search history.

(56) References Cited

U.S. PATENT DOCUMENTS 3,460,779 A * 8/1969 Peasley ..... H02G 11/02 242/370
4,130,044 A 12/1978 Yamada et al.
4,152,964 A 5/1979 Waage
4,159,664 A 7/1979 Mastronardi
4,172,403 A 10/1979 Campbell
4,176,578 A 12/1979 Campbell
4,198,890 A 4/1980 Alto
D255,904 S 7/1980 Therrien
4,217,803 A 8/1980 Dodds
4,273,917 A 6/1981 Dodds
4,345,147 A * 8/1982 Aaron ..... G06F 3/0227 235/385
4,387,623 A 6/1983 Kimble
4,419,921 A 12/1983 Simanski
4,444,083 A 4/1984 Apel
4,679,482 A 7/1987 Simanski
4,763,865 A 8/1988 Danner
4,856,407 A 8/1989 Katsuta
D311,412 S 10/1990 Ohta
5,062,342 A 11/1991 Nagatsuma
5,386,083 A 1/1995 Kawamura
5,463,925 A * 11/1995 Galocy ..... G10C 3/12 84/423 R
5,530,198 A 6/1996 Ishii
5,602,351 A 2/1997 Kawamura
5,612,691 A * 3/1997 Murmann ..... G06F 3/0216 341/22
5,679,914 A 10/1997 Niitsuma
5,712,760 A 1/1998 Coulon
5,783,765 A 7/1998 Muramatsu
5,815,369 A * 9/1998 Quesada ..... G06F 1/16 200/292
5,861,566 A 1/1999 Kaneko
5,866,831 A 2/1999 Kimble
5,874,687 A 2/1999 Kawamura
5,941,648 A 8/1999 Robinson
(Continued)

FOREIGN PATENT DOCUMENTS

DE 92 08 106.1 B1 6/1992

OTHER PUBLICATIONS smallpianokeyboards.org, "Alternatively Sized Piano Keyboards," Mar. 2018, www.smallpianokeyboards.org, Location of Publisher Unknown.

*Primary Examiner* — David S Warren
(74) *Attorney, Agent, or Firm* — J. Steven Svoboda

(57) ABSTRACT

A portable piano keyboard is configured to be separable into multiple keyboard sections.

2 Claims, 15 Drawing Sheets

(56) References Cited

U.S. PATENT DOCUMENTS 5,945,617 A 8/1999 Niitsuma
5,971,635 A 10/1999 Wise
D416,008 S 11/1999 Robinson et al.
6,011,214 A 1/2000 Kawamura
6,121,535 A 9/2000 Muramatsu
6,174,097 B1 * 1/2001 Daniel ..... G06F 3/0221 400/472
6,248,943 B1 6/2001 Inoue
6,259,006 B1 * 7/2001 Parienti ..... G10H 1/32 84/171
D448,032 S 9/2001 Talley
6,351,372 B1 2/2002 Kim
6,392,635 B1 * 5/2002 Snyder ..... G06F 3/03543 345/157
D470,493 S 2/2003 Tritschler et al.
6,525,257 B1 2/2003 Hermann
6,561,708 B2 5/2003 Lin
6,575,647 B1 * 6/2003 Daniel ..... G06F 3/0221 400/472
6,580,932 B1 6/2003 Finke-Anlauff
6,628,508 B2 9/2003 Lieu et al.
D486,488 S 2/2004 Olodort et al.
6,698,957 B2 3/2004 Huang
6,714,403 B2 3/2004 Furuki et al.
6,734,809 B1 5/2004 Olodort et al.
6,755,581 B1 6/2004 Huang et al.
6,798,649 B1 9/2004 Olodort et al.
6,839,002 B2 1/2005 Olodort et al.
6,875,913 B2 * 4/2005 Bubar ..... G10H 1/344 84/423 R
6,877,919 B2 4/2005 Sitalasai et al.
6,894,626 B2 5/2005 Olodort et al.
6,920,039 B2 7/2005 Mochizuki
D510,747 S 10/2005 Lin
6,967,831 B2 11/2005 Chuang
6,972,699 B2 12/2005 Olodort et al.
6,991,389 B2 1/2006 Mochizuki
7,031,143 B2 4/2006 Madsen
7,174,678 B2 * 2/2007 Gallant ..... A61G 7/00 52/36.1
7,175,473 B1 * 2/2007 Clapp ..... H01R 13/72 191/12.2 R
7,196,692 B2 3/2007 Mochizuki
7,199,313 B1 4/2007 Kemppinen
7,213,991 B2 5/2007 Chapman et al.
7,247,788 B2 * 7/2007 Lai ..... G10H 1/34 84/719
7,439,438 B2 10/2008 Hao
7,446,757 B2 11/2008 Mochizuki
7,463,480 B2 12/2008 Song
7,465,868 B2 * 12/2008 Lengeling ..... G10H 1/34 84/719
7,539,526 B2 5/2009 Pirila
7,540,675 B2 6/2009 Liu
7,619,154 B2 11/2009 Hammond
7,781,652 B2 8/2010 Clark et al.
7,843,575 B1 11/2010 Starkey
7,875,785 B2 1/2011 Hammond
D636,013 S 4/2011 Shin et al.
7,977,561 B2 * 7/2011 Folkesson ..... G10H 1/34 84/615
D692,432 S 10/2013 Liu et al.
8,558,098 B1 10/2013 Mauldin
8,564,942 B2 10/2013 Jiang
8,570,726 B2 10/2013 Wu
8,582,280 B2 11/2013 Ryu
8,664,497 B2 3/2014 Taylor
8,710,344 B2 4/2014 Pagoda
8,757,908 B2 6/2014 Wu
8,794,854 B2 8/2014 Lan
8,908,362 B2 12/2014 Wang
8,917,499 B1 12/2014 Read
8,941,979 B2 1/2015 Griffin
8,952,232 B2 2/2015 Parsons et al.
9,029,674 B2 * 5/2015 Gold ..... G10C 3/12 84/423 R
9,111,516 B1 * 8/2015 Saraceni ..... G10H 1/0016
9,165,476 B2 10/2015 Yoshikawa et al.
9,304,551 B1 4/2016 Peirce
9,324,310 B2 4/2016 McPherson
9,423,881 B2 8/2016 Norwalk
9,552,800 B1 1/2017 Pagoda
9,679,542 B2 6/2017 Parsons et al.
9,704,456 B2 7/2017 Dayonot
9,805,705 B2 10/2017 McPherson
2002/0144586 A1 * 10/2002 Connick, Jr. ..... G09B 15/023 84/478
2003/0056634 A1 * 3/2003 Asahi ..... G10H 1/34 84/17
2003/0184521 A1 * 10/2003 Sugita ..... G06F 3/03543 345/163
2004/0083877 A1 * 5/2004 Bubar ..... G10H 1/344 84/423 R
2004/0150957 A1 * 8/2004 Boudreaux ..... H01L 23/4338 361/719
2005/0034591 A1 * 2/2005 Chang ..... G10H 1/32 84/730
2005/0146446 A1 * 7/2005 Hsu ..... G06F 1/1632 341/22
2005/0153728 A1 7/2005 Ronkko
2005/0241467 A1 * 11/2005 Lo ..... G10H 1/344 84/744
2006/0117939 A1 * 6/2006 Lai ..... G10H 1/34 84/744
2006/0137512 A1 6/2006 Lassar
2006/0230913 A1 * 10/2006 Liao ..... G10H 1/32 84/744
2007/0041773 A1 2/2007 Pirila
2007/0221043 A1 9/2007 Hao
2007/0289431 A1 12/2007 Hammond
2008/0127799 A1 6/2008 Yamashita et al.
2008/0307943 A1 12/2008 Clark et al.
2009/0064847 A1 3/2009 Hao
2009/0188378 A1 * 7/2009 Folkesson ..... G10H 1/34 84/615
2009/0241393 A1 10/2009 Richardson
2009/0241438 A1 * 10/2009 Gallant ..... E04H 3/08 52/36.5
2009/0266218 A1 * 10/2009 Parienti ..... G10C 3/12 84/171
2010/0077905 A1 4/2010 Hammond
2010/0125727 A1 5/2010 Bae et al.
2012/0240748 A1 9/2012 Endow
2012/0272595 A1 * 11/2012 Gallant ..... E04B 2/74 52/220.7
2013/0098226 A1 * 4/2013 Bowen ..... G06F 3/0219 84/649
2013/0192444 A1 8/2013 Parsons et al.
2013/0327200 A1 12/2013 Pagoda
2013/0340592 A1 * 12/2013 Yao ..... G10H 1/344 84/354
2014/0047970 A1 2/2014 Yoshikawa et al.
2014/0083281 A1 4/2014 McPherson
2014/0202313 A1 * 7/2014 Prichard ..... G10H 1/344 84/423 R
2014/0285454 A1 9/2014 Pagoda
2015/0053063 A1 * 2/2015 Gold ..... G10C 3/12 84/423 R
2015/0107445 A1 4/2015 Parsons et al.
2015/0302835 A1 10/2015 Dayonot
2016/0240180 A1 8/2016 McPherson
2016/0363311 A1 9/2016 Toth
2017/0004813 A1 1/2017 Pagoda
2018/0018058 A1 1/2018 Pagoda
2018/0040314 A1 2/2018 Laughlin

* cited by examiner

FOLDABLE PIANO KEYBOARD

SUMMARY

Embodiments of the invention relate in general to a foldable piano keyboard. Yet other embodiments of the invention relate to a foldable piano keyboard that is separable into multiple keyboard sections. Still other embodiments of the invention relate to a foldable piano keyboard that is separable into two keyboard halves.

A portable piano keyboard is configured to be separable into multiple keyboard sections.

A portable piano keyboard configured to be separable into two keyboard halves, each keyboard half comprising approximately half the total number of keys in the keyboard, the two keyboard halves having approximately equal lengths, the two keyboard halves being foldable together to create a consolidated single unit, the keyboard having a smaller keyboard length relative to a standard 6.5-inch octave, the keyboard comprises a standard 88 keys, wherein the keyboard is foldable along a keyboard hinge, the hinge comprising an interface configured to facilitate transmission between the keyboard halves of one or more of power and electronic signals, the hinge further comprising a removable pin configured to keep the two keyboard halves together, wherein removal of the removable pin permits the two keyboard halves to be separated, wherein a first keyboard half comprises a male power connector located immediately adjacent to the hinge, the first keyboard half further comprising a female electronic connector located immediately adjacent to the hinge, wherein the male power connector and the female power connector are configured to transmit power between the keyboard halves, and wherein the second keyboard half comprises a female power connector located immediately adjacent to the hinge in a position symmetrically opposed to the male power connector, the second keyboard half further comprising a male electronic connector located immediately adjacent to the hinge in a position symmetrically opposed to the female electronic connector, wherein the male electronic connector and the female electronic connector are configured to transmit electronic signals between the keyboard halves, the hinge further comprising a connector compartment configured to hold one or more of the male power connector, the female power connector, the male electronic connector, and the female electronic connector.

A portable piano keyboard configured to be separable into two keyboard halves, each keyboard half comprising approximately half the total number of keys in the keyboard, the two keyboard halves having approximately equal lengths, the two keyboard halves being foldable together to create a consolidated single unit, the keyboard having a smaller keyboard length relative to a standard 6.5-inch octave, the keyboard comprises a standard 88 keys, wherein the keyboard is foldable along a keyboard hinge, the hinge comprising an interface configured to facilitate transmission between the keyboard halves of one or more of power and electronic signals, the hinge further comprising a removable pin configured to keep the two keyboard halves together, wherein removal of the removable pin permits the two keyboard halves to be separated, wherein a first keyboard half comprises a male power connector located immediately adjacent to the hinge, the first keyboard half further comprising a female electronic connector located immediately adjacent to the hinge, wherein the male power connector and the female power connector are configured to transmit power between the keyboard halves, and wherein the second keyboard half comprises a female power connector located immediately adjacent to the hinge in a position symmetrically opposed to the male power connector, the second keyboard half further comprising a male electronic connector located immediately adjacent to the hinge in a position symmetrically opposed to the female electronic connector, wherein the male electronic connector and the female electronic connector are configured to transmit electronic signals between the keyboard halves, the male power connector automatically mating with the female power connector upon closing the hinge, the female electronic connector automatically mating with the male electronic connector upon closing the hinge.

DESCRIPTION OF THE DRAWINGS

The accompanying drawings provide visual representations which will be used to more fully describe various representative embodiments and can be used by those skilled in the art to better understand the representative embodiments disclosed herein and their inherent advantages. In these drawings, like reference numerals identify corresponding elements.

DETAILED DESCRIPTION

Embodiments of the invention relate in general to a foldable piano keyboard. Yet other embodiments of the invention relate to a foldable piano keyboard that is separable into multiple keyboard sections. Still other embodiments of the invention relate to a foldable piano keyboard that is separable into two keyboard halves.

Other embodiments of the invention relate to a keyboard that is foldable along a keyboard junction. Still further embodiments of the invention relate to a keyboard that is foldable along a keyboard hinge. Still further embodiments of the invention relate to a keyboard comprising two keyboard halves that can be folded together to create a consolidated single keyboard unit suitable for one or more of storage and transportation from one location to another.

Further embodiments of the invention relate to a piano keyboard having a reduced size. Additional embodiments of the invention relate to a foldable piano keyboard having a reduced size. Still other embodiments of the invention relate in general to a foldable piano keyboard having a reduced size, the piano keyboard comprising 88 keys, as is standard on an analog piano, such as one or more of an upright piano and a grand piano. Yet other embodiments of the invention relate to a foldable piano keyboard that is separable into multiple keyboard sections, the piano keyboard having a reduced size, the piano keyboard comprising a standard 88 keys. Still further embodiments of the invention relate to a foldable piano keyboard that is separable into two keyboard halves, the piano keyboard having a reduced size, the piano keyboard comprising a standard 88 keys.

A piano keyboard is provided that is configured to disassemble into a plurality of sections. For example, but not necessarily, the piano keyboard is configured to disassemble into two sections. For example, each of the two sections comprises a keyboard half. For example, each keyboard half comprises approximately half of a total number of keys comprised in the keyboard. For example, the two keyboard halves have keyboard half lengths that are approximately equal.

Further embodiments of the invention relate to a keyboard having a smaller keyboard length relative to a standard 6.5-inch octave. For example, the keyboard comprises a 6.5-inch octave, the keyboard further comprising a standard 88 keys. For example, the keyboard comprises a 6-inch octave. For example, the keyboard comprises a 6-inch octave, the keyboard further comprising a standard 88 keys. For example, the keyboard comprises a 5.5-inch octave. For example, the keyboard comprises a 5.5-inch octave, the keyboard further comprising a standard 88 keys.

FIGS. 1A-1E are a set of five drawings depicting five exemplary embodiments of the keyboard.

Figure 1A:
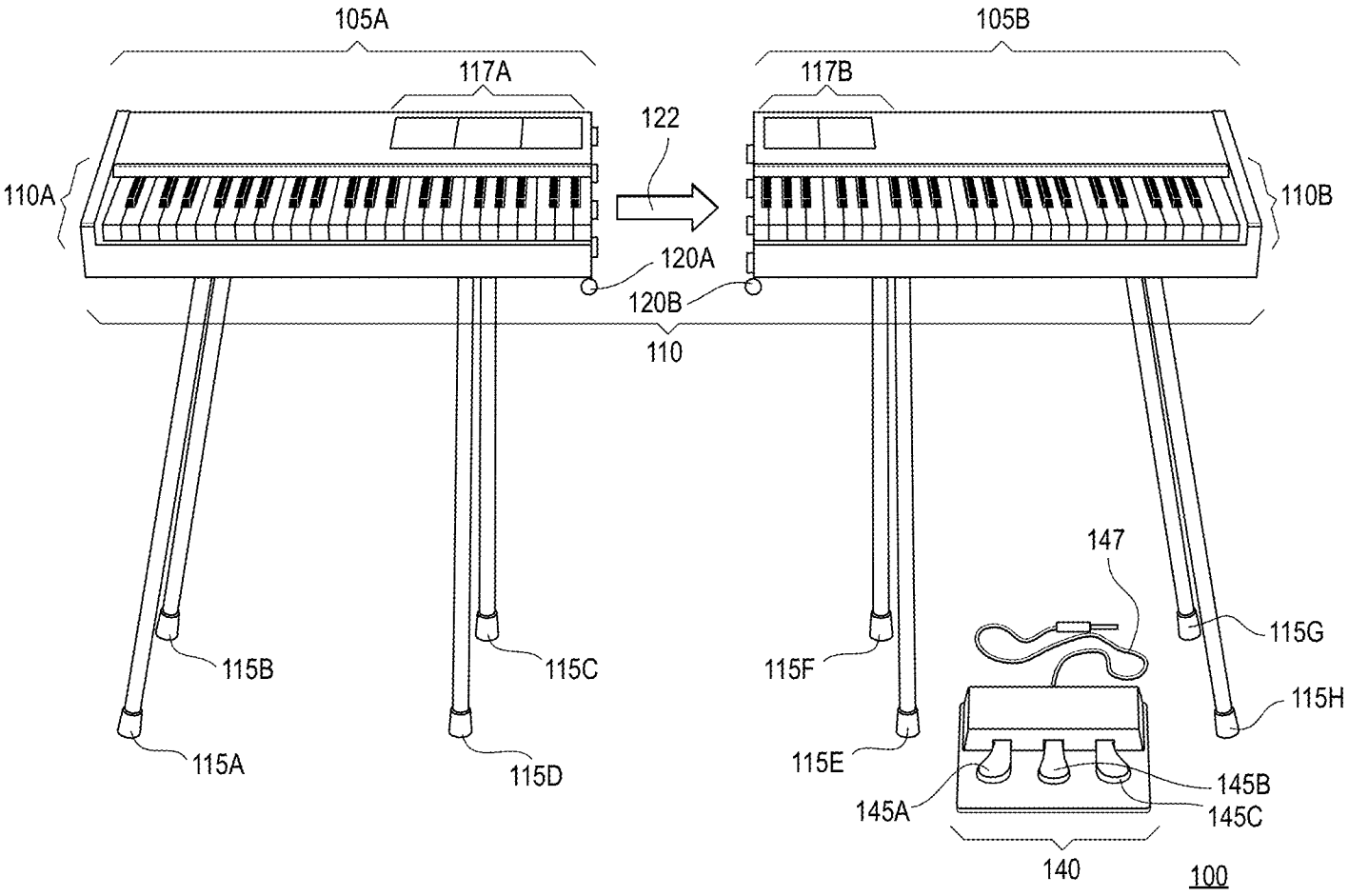
FIGS. 1A-1E are a set of five drawings depicting five exemplary embodiments of the keyboard.

FIG. 1A is a drawing depicting a foldable keyboard 100. The keyboard 100 is shown detached into two keyboard halves, a first keyboard half 105A and a second keyboard half 105B. The first keyboard half 105A comprises first keyboard keys 110A. The second keyboard half 105B comprises second keyboard keys 110B. The keyboard 100 comprises keys 110. The keys 110 comprise the first keyboard keys 110A and the second keyboard keys 110B.

The first keyboard half 105A further comprises first keyboard half legs 115A-115D, the first keyboard half legs 115A-115D configured to support the first keyboard half 105A. For example, and as depicted, the first keyboard half legs 115A-115D comprise permanent first keyboard half legs 115A and 115B. For example, and as depicted, the first keyboard half legs 115A-115D further comprise removable first keyboard half legs 115C and 115D. The removable first keyboard half legs 115C and 115D are configured to be removed from the first keyboard half 105A once the two keyboard halves 105A, 105B are joined together and the keyboard 100 is formed. Alternatively, or additionally, the removable first keyboard half legs 115C and 115D are configured to be folded conveniently out of sight when not in use.

The second keyboard half 105B further comprises second keyboard half legs 115E-115H, the second keyboard half legs 115E-115H configured to support the second keyboard half 105B. For example, and as depicted, the second keyboard half legs 115E-115H comprise permanent second keyboard half legs 115G and 115H. For example, and as depicted, the second keyboard half legs 115E-115H further comprise removable second keyboard half legs 115E and 115F. The removable second keyboard half legs 115E and 115F are configured to be removed from the second keyboard half 105B once the two keyboard halves 105A, 105B are joined together and the keyboard 100 is formed. Alternatively, or additionally, the removable second keyboard half legs 115E and 115F are configured to be folded conveniently out of sight when not in use.

Figure 3A:
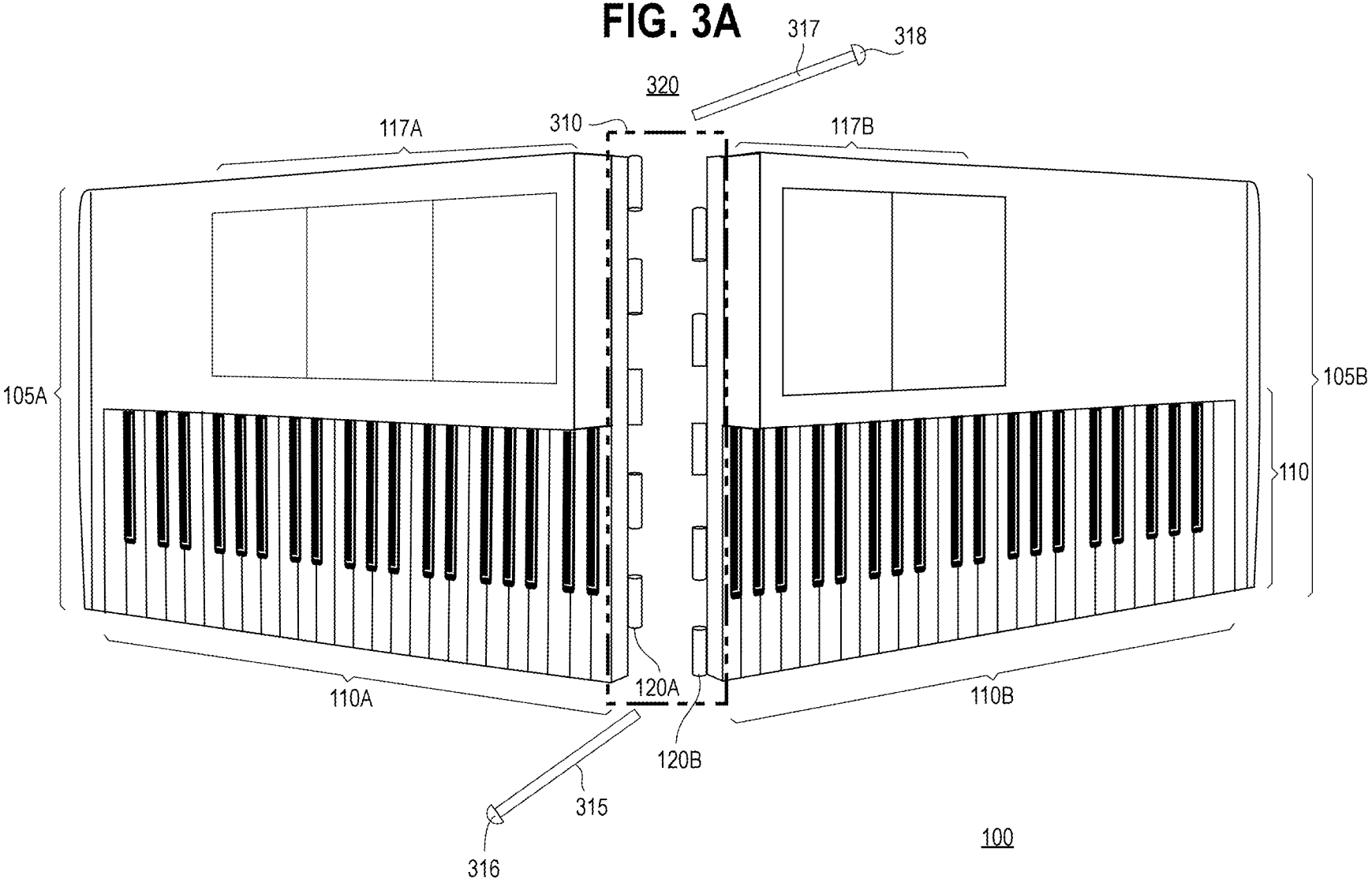
FIGS. 3A-3M are a set of thirteen drawings of different views of the foldable keyboard including detail views showing a system for connecting the two keyboard halves.

The first keyboard half 105A further comprises a first sound control section 117A. The first sound control section 117A comprises a plurality of first sound control section controls usable by the user (not shown in this figure; shown in FIG. 1D) to input sound specifications configured to affect operation of the keyboard 100. FIGS. 3A and 3G-3H, particularly FIG. 3H, depict further details of the first sound control section 117A.

The second keyboard half 105B further comprises a second sound control section 117B. The second sound control section 117B comprises a plurality of second sound controls usable by the user (not shown in this figure; shown in FIG. 1D) to input sound specifications configured to affect operation of the keyboard 100. FIGS. 3A, 3G and 3I, particularly FIG. 3I, depict further details of the second sound control section 117B.

The first keyboard half 105A further comprises a first keyboard half hinge 120A. The second keyboard half 105B further comprises a second keyboard half hinge 120B. The first keyboard half hinge 120A and the second keyboard half hinge 120B are configured together to form a keyboard hinge (not shown in FIG. 1A; item 120 in FIG. 1B) and thereby to hold together the first keyboard half 105A and the second keyboard half 105B once the two keyboard halves 105A, 105B are pushed together. Further details of the first keyboard half hinge 120A, the second keyboard half hinge 120B, and the hinge 120 are shown in FIGS. 3B-3F.

As depicted, the first keyboard half 105A is supported by the legs 115A-115D. As depicted, the second keyboard half 105B is supported by the legs 115E-115H.

The first keyboard half 105A and the second keyboard half 105B are pushed together in the direction indicated by arrow 122 to form the keyboard 100. Preferably, but not necessarily, the first keyboard half 105A and the second keyboard half 105B are pushed together in the direction indicated by the arrow 122 until the two keyboard halves 105A, 105B are in physical contact with each other. After the two keyboard halves 105A, 105B are pushed together, the first keyboard keys 110A and the second keyboard keys 110B together form the keys 110 of the keyboard 100.

The keyboard 100 further comprises a pedal console 140. Preferably, and as depicted, but not necessarily, the pedal console 140 comprises one or more of a soft pedal 145A, a sostenuto pedal 145B, a damper pedal 145C, also known as a sustaining pedal 145C, and a pedal connecting cord 147, wherein the pedal connecting cord 147 is configured to transfer a state of each pedal, e.g., one or more of pressed down and released, from the pedal console 140 to the keyboard 100. The damper pedal 140C is configured, when depressed by the user (not shown in FIG. 1A; shown as user 160 in FIG. 1D), to sustain notes that are played while the damper pedal 140C is depressed.

In FIG. 1A, the pedal console 140 is depicted as not attached to the keyboard 100. Preferably, but not necessarily, the pedal console 140 becomes operational upon the joining together of the two keyboard halves 105A, 105B.

Figure 1B:
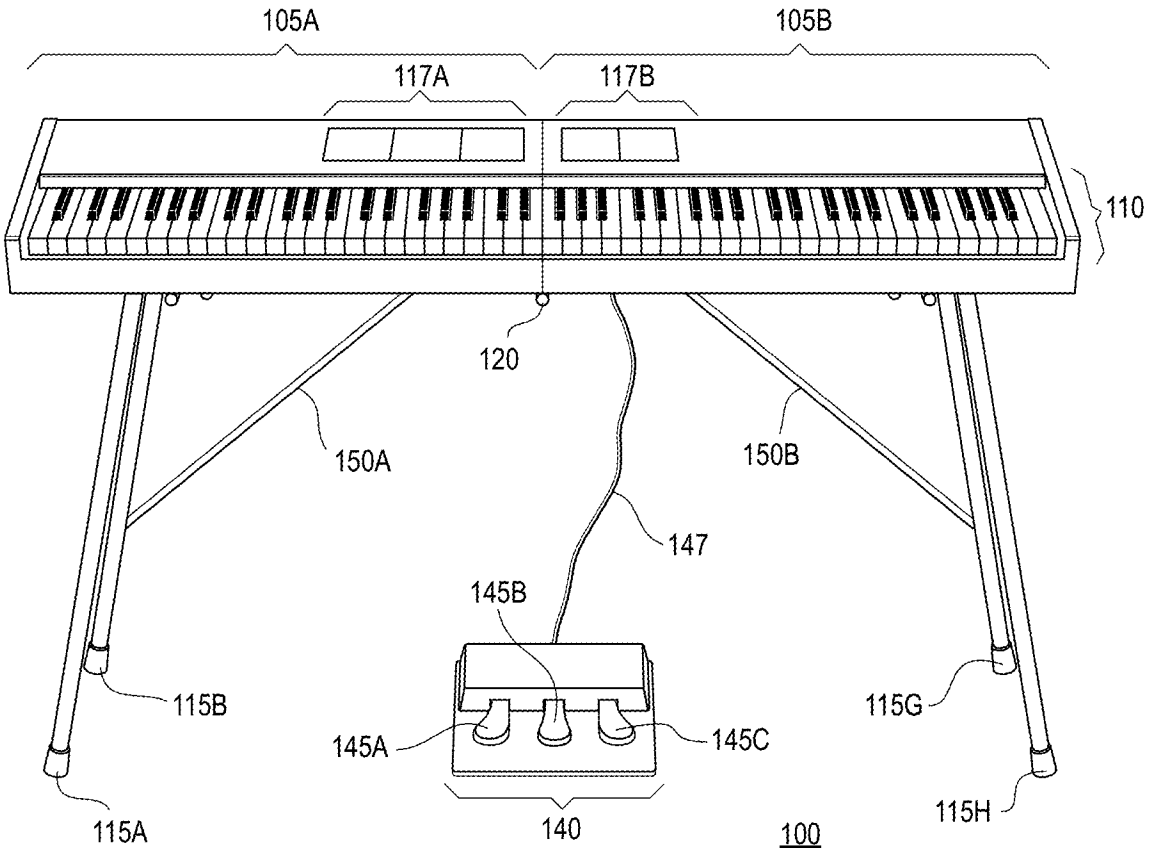

FIG. 1B is a drawing depicting a foldable keyboard 100 after it has been set up and is ready for use. The keyboard 100 has now been formed by pushing together the two keyboard halves pictured in FIG. 1A. The keyboard 100 again comprises the keys 110. The removable legs 115C-115F visible in FIG. 1A have been removed in FIG. 1B so that the keyboard 100 is fully ready for use.

For example, the keyboard keys 110 comprise weighted keyboard keys 110. The weighting of the keyboard keys 110 is configured to offer the user (not shown in FIG. 1A; shown as user 160 in FIG. 1D) a natural "feel" or "touch" that is similar to, but not identical with, a standard acoustic piano such as one or more of an upright piano and grand piano.

The first keyboard half 105A again comprises the permanent first keyboard half legs 115A and 115B.

The second keyboard half 105B again comprises the permanent second keyboard half legs 115G and 115H.

The first keyboard half 105A again further comprises the first sound control section 117A. The second keyboard half 105B again further comprises the second sound control section 117B.

Now that the two keyboard halves 105A, 105B have been pushed together, the first keyboard half hinge 120A and the second keyboard half hinge 120B together form the hinge 120.

The removable legs (items 115C-115F in FIG. 1A) are removed and are not shown in FIG. 1B. As depicted, the permanent first keyboard legs 115A-115B and the permanent second keyboard legs 115G-115H together support the keyboard 100.

The keyboard 100 further comprises legs 115A, 115B, 115G, and 115H, the legs 115A, 115B, 115G, and 115H configured to support the keyboard 100. The four middle legs (not shown in this figure; items 115C-115F in FIG. 1A) can be removed from the keyboard 100. Alternatively, or additionally, the four middle legs (not shown in this figure; items 115C-115F in FIG. 1A) can be folded back inside the keyboard 100. Optional struts 150A and 150B can be locked into place.

The keyboard 100 again further comprises the pedal console 140. Preferably, and as depicted, but not necessarily, the pedal console 140 again comprises one or more of the soft pedal 145A, the sostenuto pedal 145B, the damper pedal 145C, and the pedal connecting cord 147, wherein the pedal connecting cord 147 is again configured to transfer the state of each pedal from the pedal console 140 to the keyboard 100, e.g., one or more of pressed down and released. In FIG. 1B, the pedal console 140 is attached to the keyboard 100. (Details of one exemplary configuration of a pedal input port usable for attaching the pedal console 140 to the keyboard 100 using the pedal connecting cord 147 are provided in FIGS. 4A-4C, particularly the pedal input port 433 in FIG. 4C.) Preferably, but not necessarily, the pedal console 140 again becomes operational upon the joining together of the two keyboard halves 105A, 105B.

The first keyboard half 105A optionally further comprises a first strut 150A. The second keyboard half 105B optionally further comprises a second strut 150B. For example, one or more of the first strut 150A and the second strut 150B may be used after the two keyboard halves 105A, 105B have been joined together. Preferably, but not necessarily, and as depicted, the struts 150A and 150B are configured to provide further support for the keyboard 100.

Figure 1C:
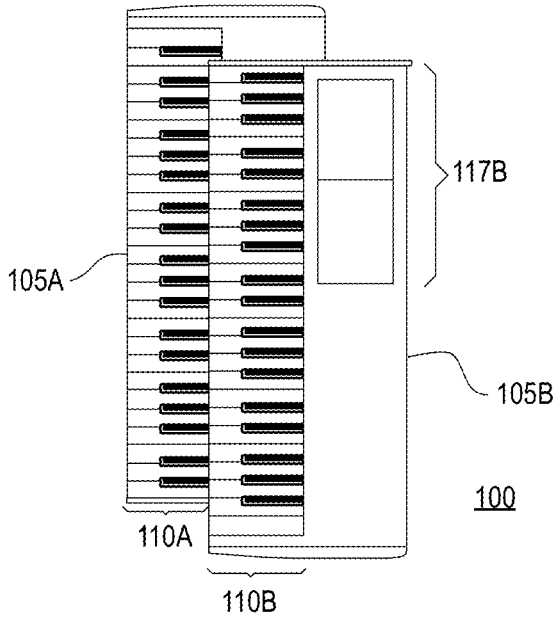

FIG. 1C is a drawing depicting the keyboard 100 detached into two keyboard halves, a first keyboard half 105A and a second keyboard half 105B. The first keyboard half 105A again comprises the first keyboard keys 110A. The first keyboard half 105A again comprises the first sound control section (item 117 in FIGS. 1A-1B; not visible in FIG. 1C). The second keyboard half 105B comprises second keyboard keys 110B. The second keyboard half 105B again comprises the second sound control section 117B. The first keyboard half 105A and the second keyboard half 105B again together form the keyboard 100. The first keyboard keys 110A and the second keyboard keys 110B again together form the standard set of 88 keys (not shown in this figure; shown as item 110 in FIG. 1A).

Figure 1D:
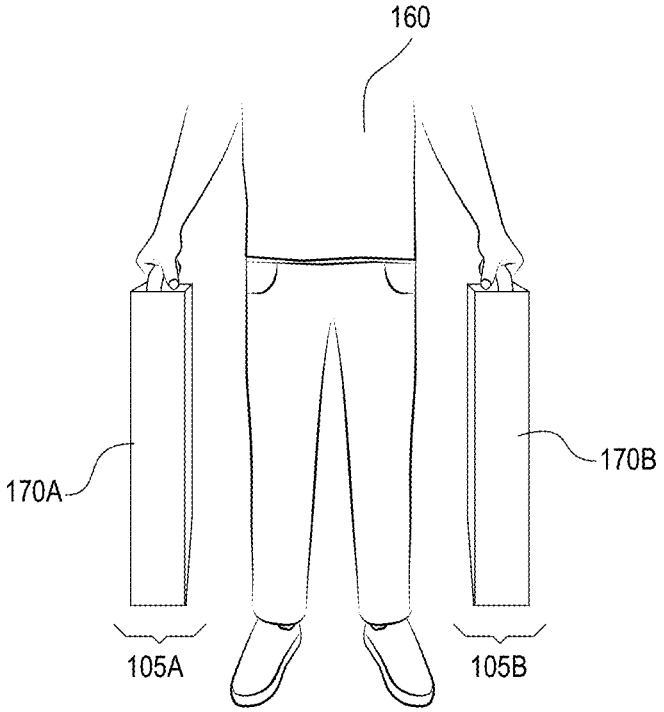

FIG. 1D is a drawing depicting a user 160 holding the two keyboard halves 105A and 105B. The first keyboard half 105A is carried in a first carrying case 170A. Similarly, the second keyboard half 105B is carried in a second carrying case 170B.

Figure 1E:
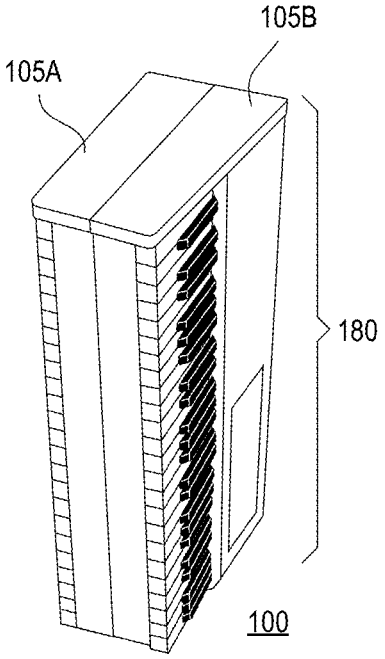

FIG. 1E is a drawing depicting the keyboard 100 with the first keyboard half 105A folded together with the second keyboard half 105B to create a consolidated single unit 180 for more convenient storage and/or transport. This configuration is heavier due to containing both keyboard halves 105A and 105B of the keyboard 100, but it can fit within a typical car trunk (not shown) or can be checked in as luggage for airline transport.

Figure 2A:
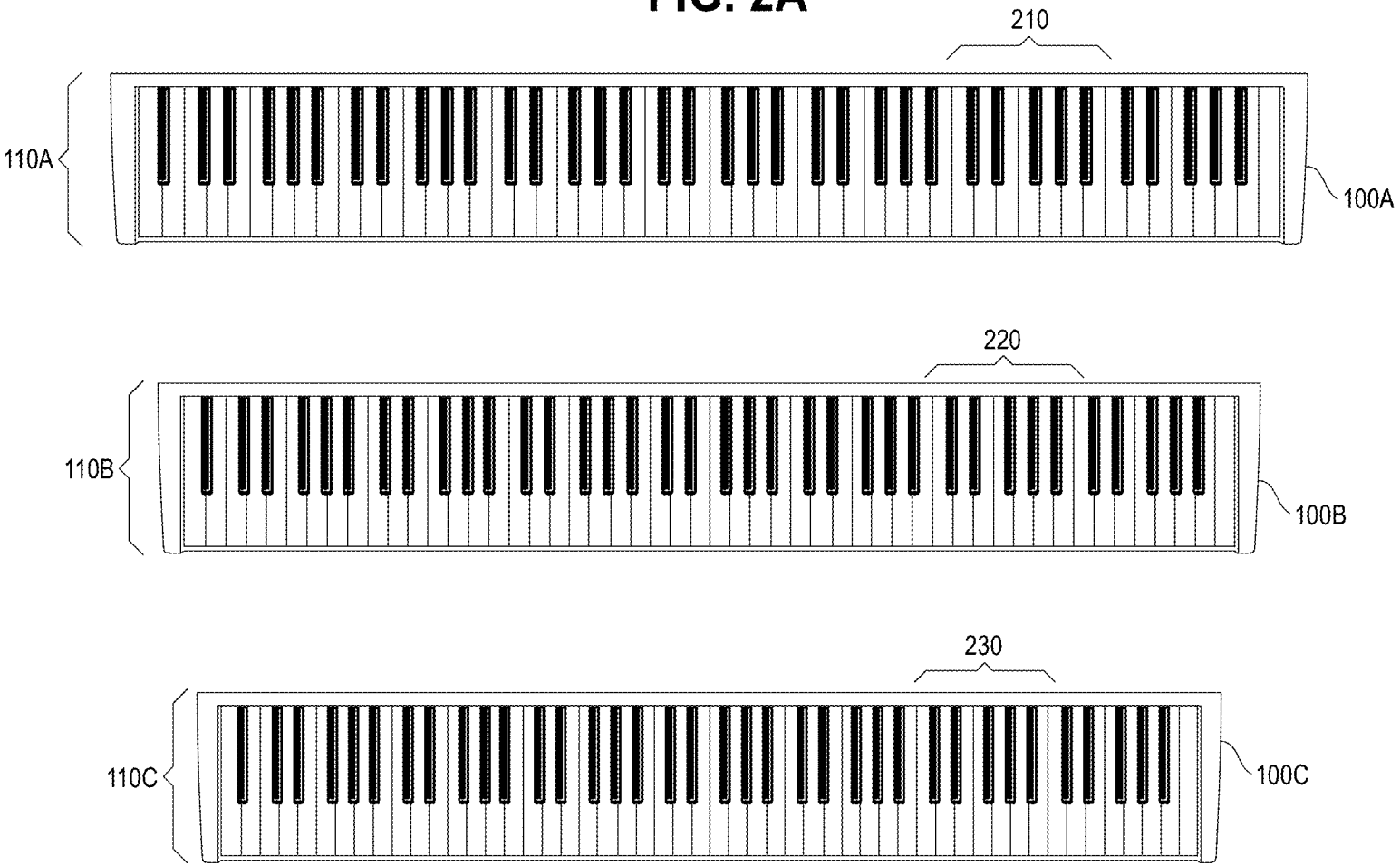
FIG. 2A is a drawing of top views of a first keyboard comprising a standard 6.5-inch first octave, of a second keyboard comprising a smaller 6.0-inch second octave, and of a third keyboard comprising a still smaller 5.5-inch third octave.

FIG. 2A is a drawing of a top view of a first keyboard 100A comprising first keyboard keys 110A. The first keyboard 100A further comprises a standard first octave 210 having an octave length of approximately 6.5 inches (16.5 cm). FIG. 2A further depicts a second keyboard 100B comprising second keyboard keys 110B. The second keyboard 100B further comprises a smaller second octave 220 having an octave length of approximately 6 inches (15.25 cm). FIG. 2A further depicts a third keyboard 100C comprising third keyboard keys 110C. The third keyboard 100C further comprises a still smaller third octave 230 having an octave length of approximately 5.5 inches (14 cm).

Figure 2B:
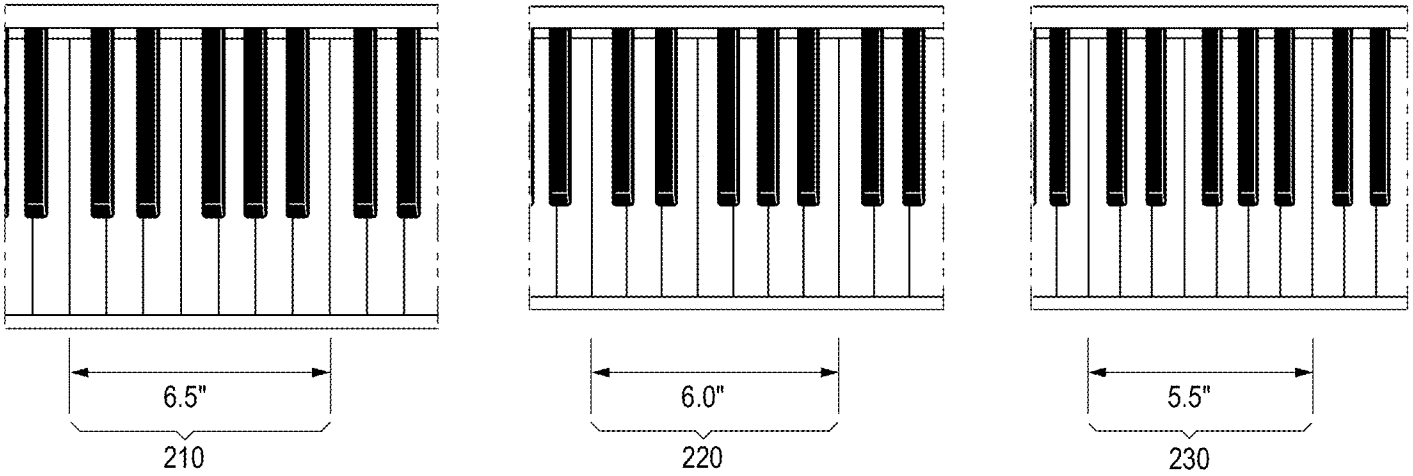
FIG. 2B is a drawing of top views of the standard 6.5-inch first octave of the first keyboard, of the smaller 6.0-inch second octave of the second keyboard, and of the still smaller 5.5-inch third octave of the third keyboard.

FIG. 2B is a drawing of top views of the standard 6.5-inch (16.5 cm) first octave 210 of the first keyboard, of the smaller 6.0-inch (16.5 cm) second octave 220 of the second keyboard, and of the still smaller 5.5-inch (14 cm) third octave 230 of the third keyboard.

FIGS. 3A-3M are a set of thirteen drawings of different views of the foldable keyboard including detail views in FIGS. 3B-3F showing an exemplary system for connecting the two keyboard halves using a first half hinge, a second half hinge configured to interlock with the first half hinge, and one or more pins configured to hold the two half hinges together. For example, the pin comprises removable pins. For example, the pin comprises steel. FIGS. 3H-3I respectively depict details of a first sound control section and a second sound control section. FIGS. 3J-3M respectively depict details of two alternative embodiments of the foldable keyboard.

FIG. 3A is a drawing depicting a top view of the keyboard 100 separated into its two keyboard halves 105A and 105B. FIG. 3A depicts the keyboard 100 folded slightly in order to show details of the connections between the two keyboard halves 105A and 105B including details of the first keyboard half hinge 120A and the second keyboard half hinge 120B.

The keyboard 100 again comprises the first keyboard half 105A, the second keyboard half 105B, the first sound control section 117A, and the second sound control section 117B. The first keyboard half 105A again comprises the first keyboard keys 110A. The second keyboard half 105B again comprises the first keyboard keys 110B. After the two keyboard halves 105A, 105B are pushed together, the first keyboard keys 110A and the second keyboard keys 110B again together form the keys 110 of the keyboard 100.

When combined, as shown above in FIG. 1B, and as shown below in FIG. 3G, the first keyboard half 105A and the second keyboard half 105B again form the keyboard 100. A detail box 310 showing one exemplary system of how the first keyboard half 105A and the second keyboard half 105B may be combined is provided in FIGS. 3B-3F.

The keyboard 100 again further comprises the first sound control section 117A. The keyboard 100 again further comprises the second sound control section 117B. The first sound control section 117A again comprises a plurality of first sound control section controls (shown in detail in FIG. 3H) usable by the user (not shown in this figure) to input sound specifications configured to affect sounds produced by operation of the keyboard 100. Similarly, the second sound control section 117B again comprises a plurality of second sound controls (shown in detail in FIG. 3I) usable by the user (not shown in this figure) to input sound specifications configured to affect the sounds produced by operation of the keyboard 100.

The first keyboard half 105A again further comprises the first keyboard half hinge 120A. For example, as depicted, the first keyboard half hinge 120A comprises a first half hinge 120A. The second keyboard half 105B again further comprises the second keyboard half hinge 120B. For example, as depicted, the second keyboard half hinge 120B comprises a second half hinge 120B. The first keyboard half hinge 120A and the second keyboard half hinge 120B are again configured together to form the keyboard hinge (not shown in FIG. 3A; item 120 in FIG. 3F) and thereby to hold together the first keyboard half 105A and the second keyboard half 105B once the two keyboard halves 105A, 105B are pushed together.

As shown below in further detail in FIGS. 3B-3F, within the detail box 310, the first keyboard half 105A and the second keyboard half 105B are joined together using the keyboard hinge (not shown in FIG. 3A; item 120 in FIG. 3F). For example, and as depicted, the first half hinge 120A and the second half hinge 120B are configured to interlock to form the keyboard hinge (not shown in FIG. 3A; item 120 in FIG. 3F). For example, a first pin 315 is insertable into one or more of the first half hinge 120A and the second half hinge 120B at a front center position 319 that is located at a front center of the keyboard 100. For example, a second pin 317 is insertable into one or more of the first half hinge 120A and the second half hinge 120B at a back center position 320 that is located at a back center of the keyboard 100. Once inserted, one or more of the first pin 315 and the second pin 317 help to hold together the first keyboard half 105A and the second keyboard half 105B.

For example, one or more of the first pin 315 and the second pin 317 is removable, allowing the first keyboard half 105A and the second keyboard half 105B to be detached from each other. For example, the first pin 315 comprises a removable first pin 315, allowing the first keyboard half 105A and the second keyboard half 105B to be detached from each other. For example, the first pin 315 comprises steel. The first pin 315 comprises a first pin head 316. For example, the second pin 317 comprises a removable second pin 317, allowing the first keyboard half 105A and the second keyboard half 105B to be detached from each other. For example, the second pin 317 comprises steel. The second pin 317 comprises a second pin head 318.

For example, detaching the first keyboard half 105A and the second keyboard half 105B creates two keyboard halves 105A, 105B, each of which weigh less than the keyboard 100. For example, detaching the first keyboard half 105A and the second keyboard half 105B facilitates one or more of transportation and storage. Further details of the first keyboard half hinge 120A, the second keyboard half hinge 120B, the first pin 315, the second pin 317, and the keyboard hinge (not shown in FIG. 3A; item 120 in FIG. 3F) are shown in FIGS. 3B-3F.

Figure 3F:
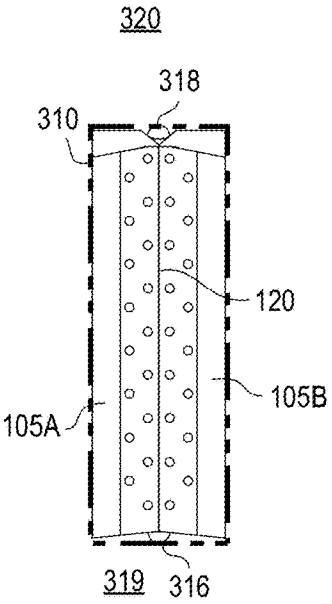
Figure 3E:
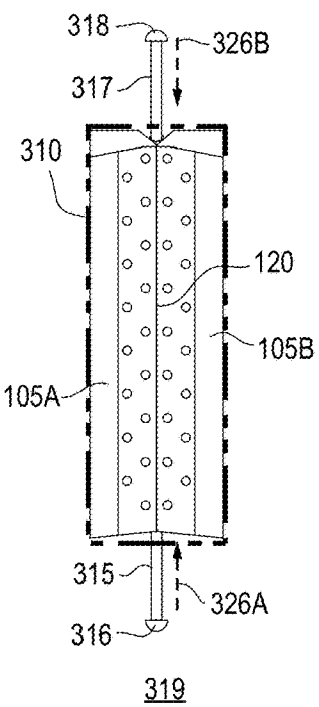
Figure 3D:
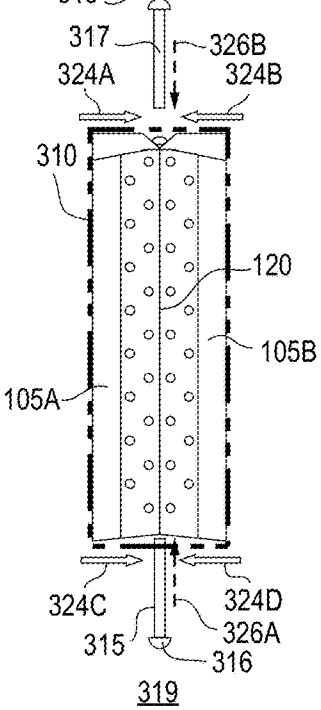
Figure 3C:
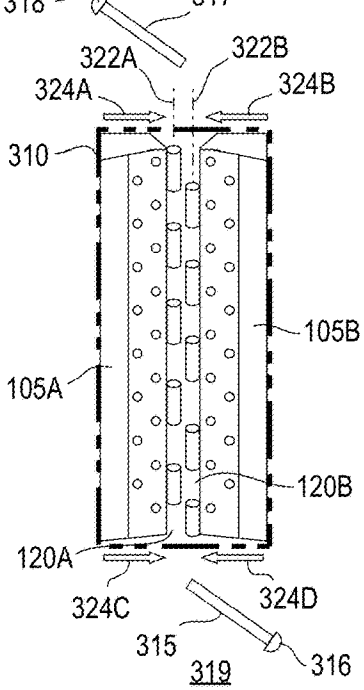
Figure 3B:
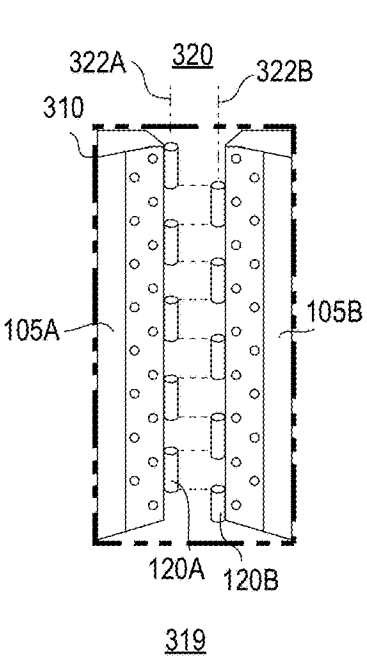
Figure 3G:
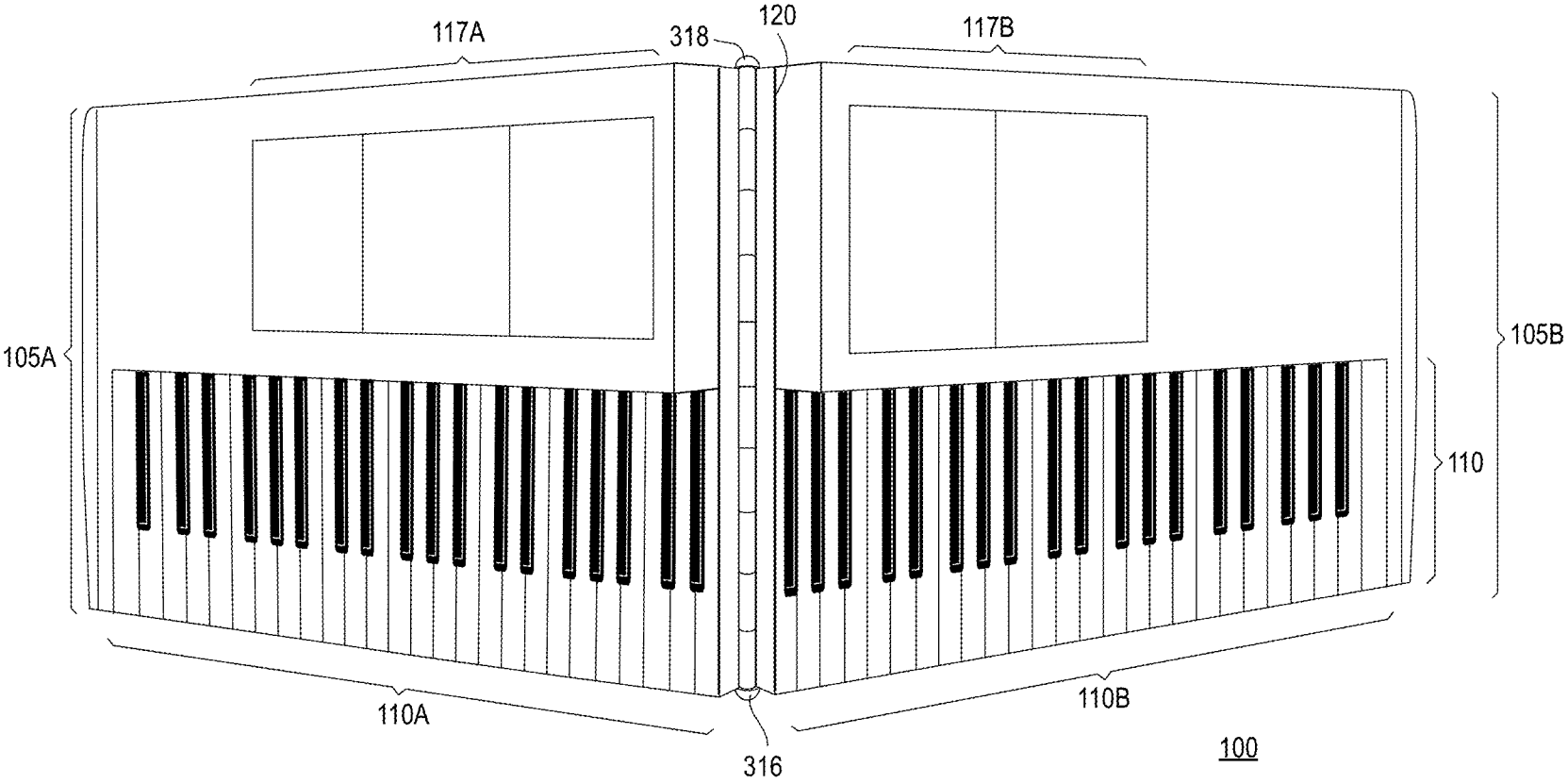
Figure 3H:
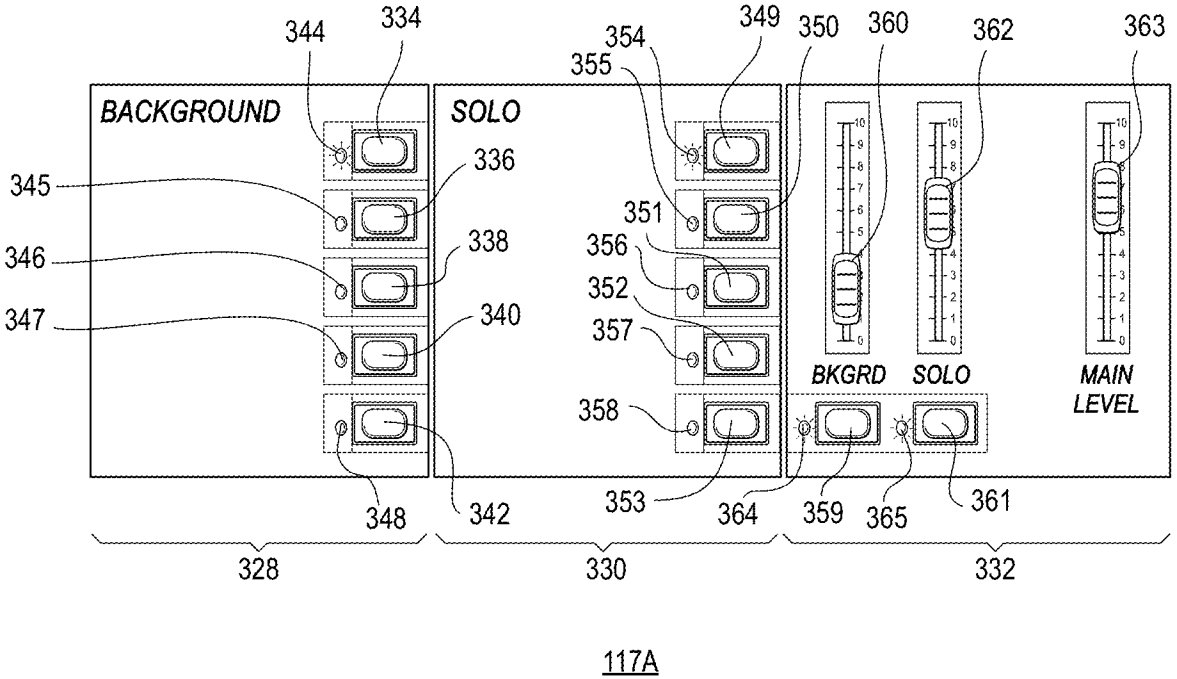
Figure 3I:
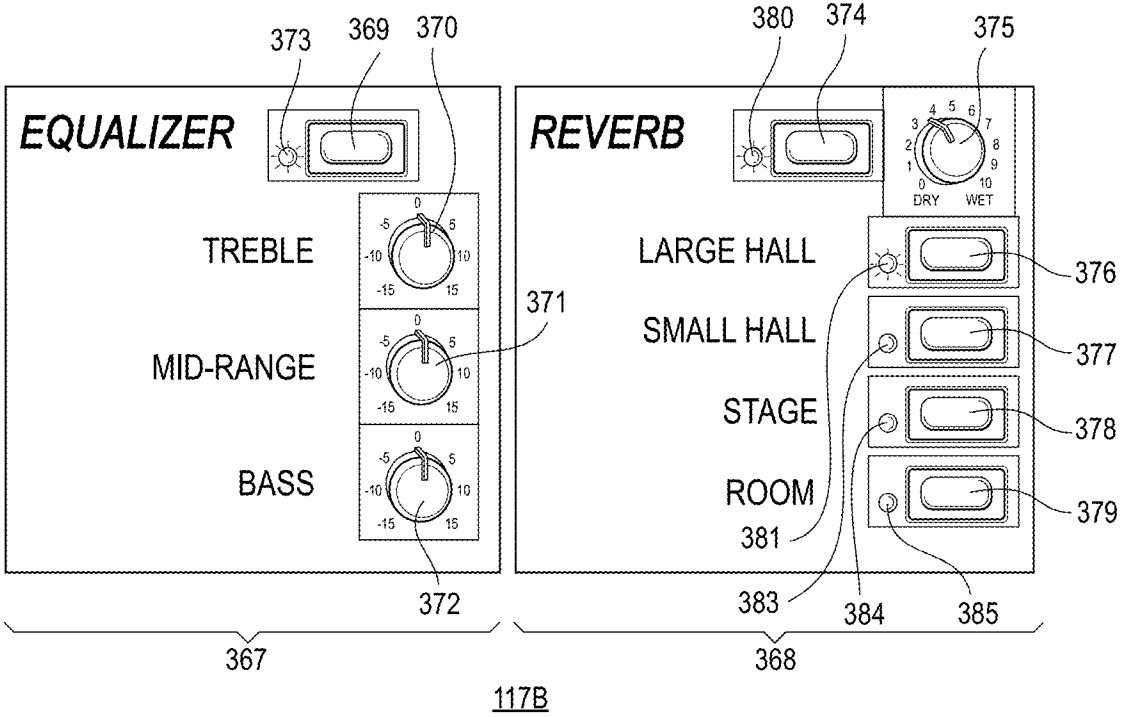

FIGS. 3B-3F depicts a five-step process of attaching the first keyboard half 105A and the second keyboard half 105B using the first keyboard half hinge 120A and the second keyboard half hinge 120B, which together will form a keyboard hinge (not shown in FIGS. 3B-3C; item 120 in FIG. 3F).

FIG. 3B is a detail drawing showing the detail box 310 depicted in FIG. 3A. FIG. 3B depicts a first step in a five-step process of attaching the first keyboard half 105A and the second keyboard half 105B using the first keyboard half hinge 120A and the second keyboard half hinge 120B, which together will form the keyboard hinge (not shown in FIG. 3B; item 120 in FIG. 3F).

As depicted in FIG. 3B, the first keyboard half 105A is fully separated from the second keyboard half 105B, and vice versa, meaning also that the first keyboard half hinge 120A is fully disengaged from the second keyboard half hinge 120B and vice versa.

The first keyboard half hinge 120A comprises a first keyboard half hinge axis 322A, and the second keyboard half hinge 120B comprises a second keyboard half hinge axis 322B. Currently, as shown in FIG. 3B, the first keyboard half hinge axis 322A is not aligned with the second keyboard half hinge axis 322B. As shown in FIG. 3B, the first keyboard half hinge axis 322A does not coincide with the second keyboard half hinge axis 322B.

FIG. 3C is a detail drawing showing the detail box 310 depicted in FIG. 3A. FIG. 3C depicts a second step in a five-step process of attaching the first keyboard half 105A and the second keyboard half 105B using the first keyboard half hinge 120A and the second keyboard half hinge 120B, which together will form the keyboard hinge (not shown in FIG. 3C; item 120 in FIG. 3F). The first keyboard half 105A and the second keyboard half 105B are moved toward each other in the directions indicated by arrows 324A-324D but not into contact with each other.

As depicted in FIG. 3C, the first keyboard half 105A and the second keyboard half 105B are brought close together and aligned with each other.

The first keyboard half hinge 120A again comprises the first keyboard half hinge axis 322A, and the second keyboard half hinge 120B again comprises the second keyboard half hinge axis 322B. Currently, as shown in FIG. 3C, the first keyboard half hinge axis 322A is again not aligned with the second keyboard half hinge axis 322B. The first keyboard half hinge axis 322A and the second keyboard half hinge axis 322B do not coincide with each other in FIG. 3C.

The first pin 315 again comprises the first pin head 316 and the second pin 317 again comprises the second pin head 318. As shown in FIG. 3C, the first pin 315 is insertable into one or more of the first half hinge 120A and the second half hinge 120B at the front center position 319 that is located at the front center of the keyboard 100. As shown in FIG. 3C, the second pin 317 is insertable into one or more of the first half hinge 120A and the second half hinge at a back center position 320 that is located at a back center of the keyboard 100. Once inserted into the keyboard hinge (not shown in FIG. 3C; item 120 in FIG. 3F), one or more of the first pin 315 and the second pin 317 will help to hold together the first keyboard half 105A and the second keyboard half 105B.

FIG. 3D is a detail drawing showing the detail box 310 depicted in FIG. 3A. FIG. 3D depicts a third step in a five-step process of attaching the first keyboard half 105A and the second keyboard half 105B using the first keyboard half hinge (not shown in FIG. 3D; item 120A in FIG. 3B) and the second keyboard half hinge (not shown in FIG. 3D; item 120B in FIG. 3B), which together form the hinge 120. The first keyboard half 105A and the second keyboard half 105B are moved toward each other in the directions indicated by arrows 324A-324D until the first keyboard half 105A contacts the second keyboard half 105B.

As depicted in FIG. 3D, the first keyboard half 105A and the second keyboard half 105B are brought together until they contact each other and the first keyboard half hinge axis (not shown in FIG. 3D; item 322A in FIG. 3C) coincides with the second keyboard half hinge axis (not shown in FIG. 3D; item 322B in FIG. 3C).

The first pin 315 again comprises the first pin head 316 and the second pin 317 again comprises the second pin head 318. As shown in FIG. 3D, the first pin 315 is moved in the first pin direction 326A in preparation to insert the first pin 315 into the hinge 120 at the front center position 319. As shown in FIG. 3D, the second pin 317 is moved in a second pin direction 326B in preparation to insert the second pin 317 into the hinge 120 at the back center position 320. Once inserted into the hinge 120, one or more of the first pin 315 and the second pin 317 will help to hold together the first keyboard half 105A and the second keyboard half 105B.

FIG. 3E is a detail drawing showing the detail box 310 depicted in FIG. 3A. FIG. 3E depicts a fourth step in a five-step process of attaching the first keyboard half 105A and the second keyboard half 105B using the first keyboard half hinge (not shown in FIG. 3E; item 120A in FIG. 3B) and the second keyboard half hinge (not shown in FIG. 3E; item 120B in FIG. 3B), which together form the hinge 120. As depicted, the hinge 120 comprises a hinge 120. The hinge 120 comprises one or more of the first pin 315 and the second pin 317.

The first pin 315 again comprises the first pin head 316 and the second pin 317 again comprises the second pin head 318. Now that the first keyboard half 105A and the second keyboard half 105B are contacting each other, the first pin 315 is moved in the first pin direction 326A to insert the first pin 315 into the hinge 120 at the front center position 319. Now that the first keyboard half 105A and the second keyboard half 105B are contacting each other, the second pin 317 is moved in the second pin direction 326B to insert the second pin 317 into the hinge 120 at the back center position 320. Now that the one or more of the first pin 315 and the second pin 317 are being inserted into the hinge 120, the one or more of the first pin 315 and the second pin 317 will help to hold together the first keyboard half 105A and the second keyboard half 105B.

FIG. 3F is a detail drawing showing the detail box 310 depicted in FIG. 3A. FIG. 3F depicts a fifth and final step in a five-step process of attaching the first keyboard half 105A and the second keyboard half 105B using the first keyboard half hinge (not shown in FIG. 3F; item 120A in FIG. 3B) and the second keyboard half hinge (not shown in FIG. 3F; item 120B in FIG. 3B), which together form the hinge 120.

The one or more of the first pin (not shown in FIG. 3F; item 315 in FIGS. 3C-3E) and the second pin (not shown in FIG. 3F; item 317 in FIGS. 3C-3E) are pushed as far as possible into the hinge 120. For example, the first pin (not shown in FIG. 3F; item 315 in FIGS. 3C-3E) is pushed into the hinge 120 until the first pin head 316 contacts a surface of the keyboard 100 at the front center position 319. For example, the second pin (not shown in FIG. 3F; item 317 in FIGS. 3C-3E) is pushed into the hinge 120 until the second pin head 318 contacts a surface of the keyboard 100 at the back center position 320.

Now that the one or more of the first pin (not shown in FIG. 3F; item 315 in FIGS. 3C-3E) and the second pin 317 have been inserted into the hinge 120, the one or more of the first pin 315 and the second pin (not shown in FIG. 3F; item 317 in FIGS. 3C-3E) help to hold together the first keyboard half 105A and the second keyboard half 105B. Further helping to hold together the first keyboard half 105A and the second keyboard half 105B is an optional latch (not shown in FIG. 3F; item 417 in FIG. 4A).

FIG. 3G is a drawing depicting a top view of the keyboard 100 after the two halves have been joined together to form the keyboard 100. As in FIG. 3A, the keyboard 100 is shown slightly folded. The keyboard 100 again comprises the first keyboard half 105A, the second keyboard half 105B, the first sound control section 117A, and the second sound control section 117B. When combined, the first keyboard half 105A and the second keyboard half 105B form the keyboard 100. The first keyboard half 105A again comprises the first keyboard keys 110A. The second keyboard half 105B again comprises the second keyboard keys 110B. When combined, the first keyboard keys 110A and the second keyboard keys 110B together form the keyboard keys 110.

The first keyboard half 105A again further comprises the first keyboard half hinge 120A. The second keyboard half 105B again further comprises the second keyboard half hinge 120B. The first keyboard half hinge 120A (not shown in FIG. 3G; item 120A in FIG. 3A) and the second keyboard half hinge 120B (not shown in FIG. 3G; item 120B in FIG. 3A) are again configured together to form the hinge 120 and thereby to hold together the first keyboard half 105A and the second keyboard half 105B once the two keyboard halves 105A, 105B are pushed together. Further details of the first keyboard half hinge 120A, the second keyboard half hinge 120B, and the hinge 120 are shown in FIGS. 3B-3F.

FIG. 3H is a drawing of the first sound control section 117A of the keyboard (not shown in FIG. 3H; item 100 in FIGS. 3A and 3G). For example, and as depicted, the first keyboard half (not shown in FIG. 3H; item 105A in FIGS. 3A and 3G) comprises the first sound control section 117A.

As depicted, the first sound control section 117A comprises a background section 328, a solo section 330, and a master control section 332. The background section 328 is configured to control simulated play in the background of one or more instruments designated by the user (not shown in this figure) as the piano keyboard 100 plays. The solo section 330 is configured to control simulated solo play of an instrument designated by the user (not shown in this figure) as the piano keyboard 100 plays. The master control section 332 is configured to provide the user (not shown in this figure) with master controls for operation of one or more of the background section 328 and the solo section 330. The master control section provides master controls for one or more of a volume level of the background section 328 and a volume level of the solo section 330. Preferably, the master control section provides master controls for a volume level of the background section 328 and a volume level of the solo section 330. The master control section 332 is further configured to provide the user (not shown in this figure) with a main volume control for the piano keyboard 100.

As depicted, the background section 328 comprises a first background control 334, a second background control 336, a third background control 338, a fourth background control 340, and a fifth background control 342. The background controls 334, 336, 338, 340, and 342 are configured to provide simulated play in the background of one or more instruments as the piano keyboard 100 plays. Preferably, but not necessarily, each background control 334, 336, 338, 340, and 342, when toggled into an on position, lights a small red light adjacent to the corresponding background control 334, 336, 338, 340, 342. Preferably, but not necessarily, each background control 334, 336, 338, 340, and 342, when toggled into an on position, activates a simulated background sound associated with the respective background control 334, 336, 338, 340, 342. Preferably, but not necessarily, when each respective background control 334, 336, 338, 340, and 342 is toggled into an off setting, the respective background control light is turned off. When the respective background control 334, 336, 338, 340, 342 is toggled into the off setting, the respective background control 334, 336, 338, 340, 342 is deactivated.

As depicted, the background section 328 comprises a legato strings button 334, a pizzicato strings button 336, an orchestra button 338, a vibraphones button 340, and an accordion button 342. The legato strings button 334 simulates strings (violin, viola, cello, and so on) playing in the background in legato (smooth and flowing) style. The pizzicato strings button 336 simulates strings (violin, viola, cello, and so on) playing in the background in pizzicato (plucked) style. The orchestra button 338 simulates an orchestra playing in the background. The vibraphones button 340 simulates vibraphones playing in the background. The accordion button 342 simulates an accordion playing in the background.

As depicted, the background section 328 further comprises a legato strings light 344 adjacent to the legato strings button 334. When the legato strings button 334 has been selected, the legato strings light 344 is illuminated. When the legato strings button 344 has not been selected, the legato strings light 344 is not illuminated.

As depicted, the background section 328 further comprises a pizzicato strings light 345 adjacent to the pizzicato strings button 336. When the pizzicato strings button 336 has been selected, the pizzicato strings light 345 is illuminated. When the pizzicato strings button 336 has not been selected, the pizzicato strings light 345 is not illuminated.

As depicted, the background section 328 further comprises an orchestra light 346 adjacent to the orchestra button 338. When the orchestra button 338 has been selected, the orchestra light 346 is illuminated. When the orchestra button 338 has not been selected, the orchestra light 346 is not illuminated.

As depicted, the background section 328 further comprises a vibraphones light 347 adjacent to the vibraphones button 340. When the vibraphones button 340 has been selected, the vibraphones light 347 is illuminated. When the vibraphones button 340 has not been selected, the vibraphones light 347 is not illuminated.

As depicted, the background section 328 further comprises an accordion light 348 adjacent to the accordion button 342. When the accordion button 342 has been selected, the accordion light 348 is illuminated. When the accordion button 342 has not been selected, the accordion light 348 is not illuminated.

As depicted, the legato strings button 334 has been selected and the legato strings light 344 adjacent to the legato strings button 334 is illuminated.

As depicted, the solo section 330 comprises a first solo control 349, a second solo control 350, a third solo control 351, a fourth solo control 352, and a fifth solo control 353. The solo controls 349, 350, 351, 352, and 353 are configured to provide simulated solo play of a designated instrument as the piano keyboard 100 plays. Preferably, but not necessarily, each solo control 349, 350, 351, 352, and 353, when toggled into an on position, lights a small red light adjacent to the corresponding solo control 349, 350, 351, 352, and 353. Preferably but not necessarily, each solo control 349, 350, 351, 352, and 353, when toggled into an on position, activates the respective solo control 349, 350, 351, 352, and 353. Preferably, but not necessarily, when each respective solo control 349, 350, 351, 352, and 353 is toggled into an off setting, the respective solo control light is turned off. When the respective solo control 349, 350, 351, 352, and 353 is toggled into the off setting, the respective solo control 349, 350, 351, 352, and 353 is deactivated.

As depicted, the solo section 330 comprises a first piano button 349, a second piano button 350, a jazz piano button 351, a harpsichord button 352, and a solo strings button 353. The first piano button 349 simulates a first piano playing solo. For example, the first piano comprises a grand piano. The second piano button 350 simulates a second piano playing solo. For example, the second piano comprises an upright piano. The jazz piano button 351 simulates a jazz piano playing solo. The harpsichord button 352 simulates a harpsichord playing solo. The solo strings button 353 simulates strings (violin, viola, cello, and so on) playing solo.

As depicted, the solo section 330 further comprises a first piano light 354 adjacent to the first piano button 349. When the first piano button 349 has been selected, the first piano light 354 is illuminated. When the first piano button 349 has not been selected, the first piano light 354 is not illuminated.

As depicted, the solo section 330 further comprises a second piano light 355 adjacent to the second piano button 350. When the second piano button 350 has been selected, the second piano light 355 is illuminated. When the second piano button 350 has not been selected, the second piano light 355 is not illuminated.

As depicted, the solo section 330 further comprises a jazz piano light 356 adjacent to the jazz piano button 351. When the jazz piano button 351 has been selected, the jazz piano light 356 is illuminated. When the jazz piano button 351 has not been selected, the jazz piano light 356 is not illuminated.

As depicted, the solo section 330 further comprises a harpsichord light 357 adjacent to the harpsichord button 352. When the harpsichord button 352 has been selected, the harpsichord light 357 is illuminated. When the harpsichord button 352 has not been selected, the harpsichord light 357 is not illuminated.

As depicted, the solo section 330 further comprises a solo strings light 358 adjacent to the solo strings button 353. When the solo strings button 353 has been selected, the solo strings light 358 is illuminated. When the solo strings button 353 has not been selected, the solo strings light 358 is not illuminated.

As depicted, the first piano button 349 has been selected and the first piano light 354 adjacent to the first piano button 349 is illuminated.

As depicted, the master control section 332 comprises a first master control 359, a second master control 360, a third master control 361, a fourth master control 362, and a fifth master control 363. The master controls 359, 360, 361, 362, and 363 are configured to provide the user (not shown in this figure) with master control of one or more of the background section 328, the solo section 330, and the keyboard 100 as the piano keyboard 100 plays.

As depicted, the first master control 359 comprises a background section control button 359. For example, the background section control button 359 comprises a toggleable background section control button 359. For example, and as depicted, the second master control 360 comprises a background section volume slider 360. When toggled into an on setting, the background section control button 359 activates the background section volume slider 360. Preferably, but not necessarily, when toggled into an on setting, the background section control button 359 lights a small red background section control light 364 adjacent to the background section control button 359. When the background section control button 359 is toggled into an off setting, the background section volume slider 360 is deactivated. Preferably, but not necessarily, when the background section control button 359 is toggled into the off setting, the background section control light 364 is turned off.

As depicted, the second master control 360 comprises a background section volume slider 360. When the background section control button 359 is toggled into an on setting, the background section volume slider 360 allows the user (not shown in this figure) to select a background volume for the background section 328. As depicted, ten is a maximum background volume selectable for the background section 328 using the background section volume slider 360. As depicted, zero is a minimum background volume selectable for the background section 328 using the background section volume slider 360. When the background section control button 359 is toggled into an off setting, changing a setting of the background section volume slider 360 has no discernible effect on the keyboard 100.

As depicted, the third master control 361 comprises a solo section control button 361. For example, the solo section control button 361 comprises a toggleable solo section control button 361. For example, and as depicted, the fourth master control 362 comprises a solo section volume slider 362. When toggled into an on setting, the solo section control button 361 activates the solo section volume slider 362. Preferably, but not necessarily, when toggled into an on setting, the solo section control button 361 lights a small red solo section control light 365 adjacent to the solo section control button 361. When the solo section control button 361 is toggled into an off setting, the solo section volume slider 362 is deactivated. Preferably, but not necessarily, when the solo section control button 361 is toggled into the off setting, the solo section control light 365 is turned off.

As depicted, the fourth master control 362 comprises a solo section volume slider 362. When the solo section control button 361 is toggled into the on setting, the solo section volume slider 362 allows the user (not shown in this figure) to select a solo volume for the solo section 330. As depicted, ten is a maximum solo volume selectable for the solo section 330 using the solo section volume slider 362. As depicted, zero is a minimum solo volume selectable for the solo section 330 using the solo section volume slider 362. When the solo section control button 361 is toggled into an off setting, changing a setting of the solo section volume slider 362 has no discernible effect on the keyboard 100.

As depicted, the fifth master control 363 comprises a main level volume slider 363. The main level volume slider 363 allows the user (not shown in this figure) to select a main level for the playing volume of the keyboard 100. As depicted, ten is a maximum volume selectable for the keyboard 100 using the main level volume slider 363. As depicted, zero is a minimum volume selectable for the keyboard 100 using the main level volume slider 363.

FIG. 3I is a drawing of the second sound control section 117B of the keyboard (not shown in FIG. 3I; item 100 in FIGS. 3A and 3G). For example, and as depicted, the second keyboard half (not shown in FIG. 3I; item 105B in FIGS. 3A and 3G) comprises the second sound control section 117B.

As depicted, the second sound control section 117B comprises an equalizer section 367 and a reverb section 368. The equalizer section 367 is configured to control relative levels of high frequencies played by the keyboard 100, mid-range frequencies played by the keyboard 100, and low frequencies played by the keyboard 100. The high frequencies are also known as treble and the low frequencies are also known as bass. High frequencies (treble) may range from approximately 1,000 Hertz (Hz) up to approximately 8,000 Hz or higher. Mid-range frequencies may range from approximately 200 Hz to approximately 1,000 Hz. Low frequencies (bass) may range from approximately 20 Hz or lower to approximately 200 Hz.

As depicted, the equalizer section 367 comprises a first equalizer control 369, a second equalizer control 370, a third equalizer control 371, and a fourth equalizer control 372. The equalizer controls 369, 370, 371, and 372 are configured to control relative levels of treble played by the keyboard 100, mid-range frequencies played by the keyboard 100, and bass played by the keyboard 100.

As depicted, the first equalizer control 369 comprises an equalizer section control button 369. For example, the equalizer section control button 369 comprises a toggleable equalizer section control button 369. When toggled into an on setting, the equalizer section control button 369 activates the remaining equalizer controls 370, 371, and 372. Preferably, but not necessarily, when toggled into an on setting, the equalizer section control button 369 lights a small red equalizer section control light 373 adjacent to the equalizer section control button 369.

When the equalizer section control button 369 is toggled into an off setting, the remaining equalizer controls 370, 371, and 372 are deactivated.

As depicted, the second equalizer control 370 comprises a treble level dial 370. When the equalizer section control button 369 is toggled into an on setting, the treble level dial 370 allows the user (not shown in this figure) to select a treble level for the treble frequencies. As depicted, 15 is a maximum treble level selectable for the treble frequencies using the treble level dial 370 and −15 is a minimum treble level selectable for the treble frequencies using the treble level dial 370. When the equalizer section control button 369 is toggled into an off setting, changing a setting of the treble level dial 370 has no discernible effect on the keyboard 100.

As depicted, the third equalizer control 371 comprises a mid-range level dial 371. When the equalizer section control button 369 is toggled into the on setting, the mid-range level dial 371 allows the user (not shown in this figure) to select a mid-range level for the mid-range frequencies. As depicted, 15 is a maximum mid-range level selectable for the mid-range frequencies using the mid-range level dial 371 and −15 is a minimum mid-range level selectable for the mid-range frequencies using the mid-range level dial 371. When the equalizer section control button 369 is toggled into the off setting, changing a setting of the mid-range level dial 371 has no discernible effect on the keyboard 100.

As depicted, the fourth equalizer control 372 comprises a bass level dial 372. When the equalizer section control button 369 is toggled into the on setting, the bass level dial 372 allows the user (not shown in this figure) to select a bass level for the bass frequencies. As depicted, 15 is a maximum bass level selectable for the bass frequencies using the bass level dial 372 and −15 is a minimum bass level selectable for the bass frequencies using the bass level dial 372. When the equalizer section control button 369 is toggled into the off setting, changing a setting of the bass level dial 372 has no discernible effect on the keyboard 100.

The reverb section 368 is configured to control a level of reverberation caused by playing the keyboard 100, depending on a type of setting in which the keyboard 100 is being played. As depicted, the reverb section 368 controls the level of reverberation caused by playing the keyboard 100 in one or more of a large hall (not shown), a small hall (not shown), on a stage (not shown), and in a room (not shown). For example, a large hall comprises dimensions of approximately 200 feet by approximately 300 feet. For example, a small hall comprises dimensions of approximately 100 feet by approximately 150 feet. For example, a stage comprises dimensions of approximately 40 feet by approximately 60 feet. For example, a room comprises dimensions of approximately 25 feet by 30 feet.

As depicted, the reverb section 368 comprises a first reverb control 374, a second reverb control 375, a third reverb control 376, a fourth reverb control 377, a fifth reverb control 378, and a sixth reverb control 379. The reverb controls 374, 375, 376, 377, 378, and 379 are configured to control one or more of a reverberation level and a reverberation sound quality of a reverberation caused by playing the keyboard in the one or more of the large hall, the small hall, on the stage, and in the room.

As depicted, the first reverb control 374 comprises a reverb section control button 374. For example, the reverb section control button 374 comprises a toggleable reverb section control button 374. When toggled into an on setting, the reverb section control button 374 activates the remaining reverb controls 375, 376, 377, 378, 379. Preferably, but not necessarily, when toggled into the on setting, the reverb section control button 374 lights a small red reverb section control light 380 adjacent to the reverb section control button 374. Preferably, but not necessarily, when the reverb control button 374 is toggled into an off setting, the reverb section control light 380 is turned off. When the reverb section control button 374 is toggled into the off setting, the remaining reverb controls 375, 376, 377, 378, 379 are deactivated.

As depicted, the second reverb control 375 comprises a reverb level dial 375. When the reverb section control button 374 is toggled into the on setting, the reverb level dial 375 allows the user (not shown in this figure) to select a reverb section level for the reverb section 368. As depicted, ten is a maximum reverb section level selectable for the reverb section 368 using the reverb level dial 375. As depicted, a high reverb section level on the reverb level dial 375 is known colloquially as a "wet" reverb. As depicted, zero is a minimum reverb section level selectable for the reverb section 368 using the reverb level dial 375. As depicted, a low reverb section level on the reverb level dial 375 is known colloquially as a "dry" reverb. When the reverb section control button 374 is toggled into the off setting, changing a setting of the reverb level dial 375 has no discernible effect on the keyboard 100.

As depicted, the third reverb control 376 comprises a large hall button 376. When the reverb section control button 374 is toggled into an on position, and when the large hall button 376 is also toggled into an on position, a preset reverberation simulating a large hall is created by playing the keyboard 100. Preferably, but not necessarily, when toggled into the on setting, the large hall button 376 lights a large hall light 381 adjacent to the reverb section control button 376. Preferably, but not necessarily, when the large hall button 376 is toggled into an off setting, the large hall light 381 is turned off. When the reverb section control button 374 is toggled into the off setting, the remaining reverb controls 375, 376, 377, 378, 379 are deactivated.

As depicted, the fourth reverb control 377 comprises a small hall button 377. When the reverb section control button 374 is toggled into an on position, and when the small hall button 377 is also toggled into an on position, a preset reverberation simulating a small hall is created by playing the keyboard 100. Preferably, but not necessarily, when toggled into the on setting, the small hall button 377 lights a small hall light 383 adjacent to the reverb section control button 377. Preferably, but not necessarily, when the small hall button 377 is toggled into an off setting, the small hall light 383 is turned off. When the reverb section control button 374 is toggled into the off setting, the remaining reverb controls 375, 376, 377, 378, 379 are deactivated.

As depicted, the fifth reverb control 378 comprises a stage button 378. When the reverb section control button 374 is toggled into an on position, and when the stage button 378 is also toggled into an on position, a preset reverberation simulating a stage is created by playing the keyboard 100. Preferably, but not necessarily, when toggled into the on setting, the stage button 378 lights a stage light 384 adjacent to the reverb section control button 378. Preferably, but not necessarily, when the stage button 378 is toggled into an off setting, the stage light 384 is turned off. When the reverb section control button 374 is toggled into the off setting, the remaining reverb controls 375, 376, 377, 378, 379 are deactivated.

As depicted, the fourth reverb control 379 comprises a room button 379. When the reverb section control button 374 is toggled into an on position, and when the room button 379 is also toggled into an on position, a preset reverberation simulating a room is created by playing the keyboard 100. Preferably, but not necessarily, when toggled into the on setting, the room button 379 lights a room light 385 adjacent to the reverb section control button 379. Preferably, but not necessarily, when the room button 379 is toggled into an off setting, the room light 385 is turned off. When the reverb section control button 374 is toggled into the off setting, the remaining reverb controls 375, 376, 377, 378, 379 are deactivated.

Figure 3J:
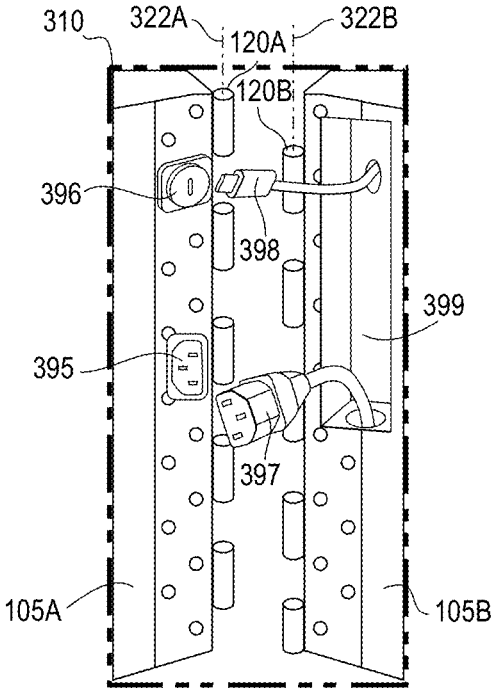
Figure 3K:
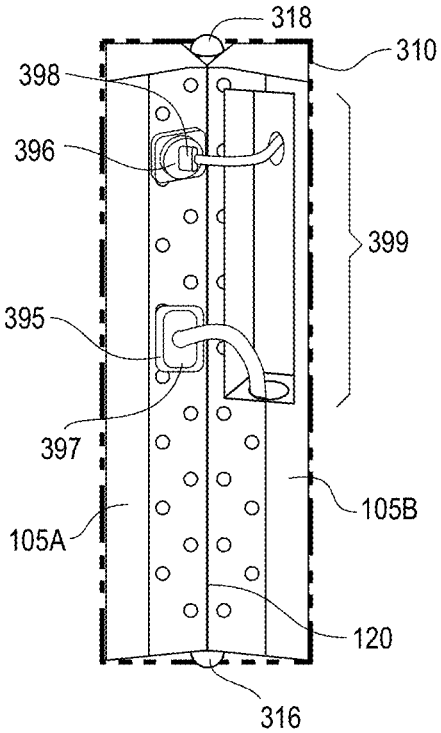

FIGS. 3J-3K are a pair of drawings that depict one or more of a first alternative embodiment and a first supplemental embodiment to the system depicted in detail in FIGS. 3B-3F for attaching the first keyboard half 105A and the second keyboard half 105B using the first keyboard half hinge 120A and the second keyboard half hinge 120B, which together form the keyboard hinge (not shown in FIGS. 3B-3C nor in FIG. 3J; item 120 in FIGS. 3F and 3K). As depicted in FIGS. 3J-3K, the second keyboard half 105B comprises a female power connector on a cable located immediately adjacent to the hinge, and the first keyboard half 105A comprises a male power connector located immediately adjacent to the hinge in a symmetrically opposed position. As further depicted in FIGS. 3J-3K, the second keyboard half 105B comprises a male electronic connector attached to a cable, and the first keyboard half 105A comprises a female electronic connector located immediately adjacent to the hinge in a symmetrically opposed position.

FIG. 3J is a detail drawing showing the detail box 310 depicted in FIGS. 3A and 3B according to this first supplemental or first alternative embodiment. FIG. 3J depicts a corollary drawing to FIG. 3B, showing the same view as is shown in FIG. 3B but for the first supplemental or first alternative embodiment. As with FIG. 3B, FIG. 3J depicts a first step in a five-step process, according to this first supplemental or first alternative embodiment, of attaching the first keyboard half 105A and the second keyboard half 105B using the first keyboard half hinge 120A and the second keyboard half hinge 120B, which together will form the keyboard hinge (not shown in FIG. 3J; item 120 in FIGS. 3F and 3K).

According to this example, the hinge (not shown in FIG. 3J; item 120 in FIGS. 3F and 3K) is formed from the first keyboard half hinge 120A and the second keyboard half hinge 120B, the hinge comprising an interface (not shown in FIG. 3J; item 120 in FIGS. 3F and 3K) configured to facilitate transmission between the keyboard halves 105A, 105B of one or more of electronic signals and electrical power. For example, the electronic signals comprise audio signals. For example, the electrical power comprises alternating current (AC) supplied by a wall power outlet (not shown).

The detail box 310 again comprises the first keyboard half 105A and the second keyboard half 105B, which are again being attached to each other using the first keyboard half hinge 120A and the second keyboard half hinge 120B, which together will form the keyboard hinge (not shown in FIGS. 3B-3C and 3J; item 120 in FIGS. 3F and 3K).

As depicted in FIG. 3J, the first keyboard half 105A is again fully separated from the second keyboard half 105B, and vice versa, meaning also that the first keyboard half hinge 120A is again fully disengaged from the second keyboard half hinge 120B and vice versa.

The first keyboard half hinge 120A again comprises the first keyboard half hinge axis 322A, and the second keyboard half hinge 120B again comprises the second keyboard half hinge axis 322B. Currently, as shown in FIG. 3J, the first keyboard half hinge axis 322A is not aligned with the second keyboard half hinge axis 322B.

Figure 4A:
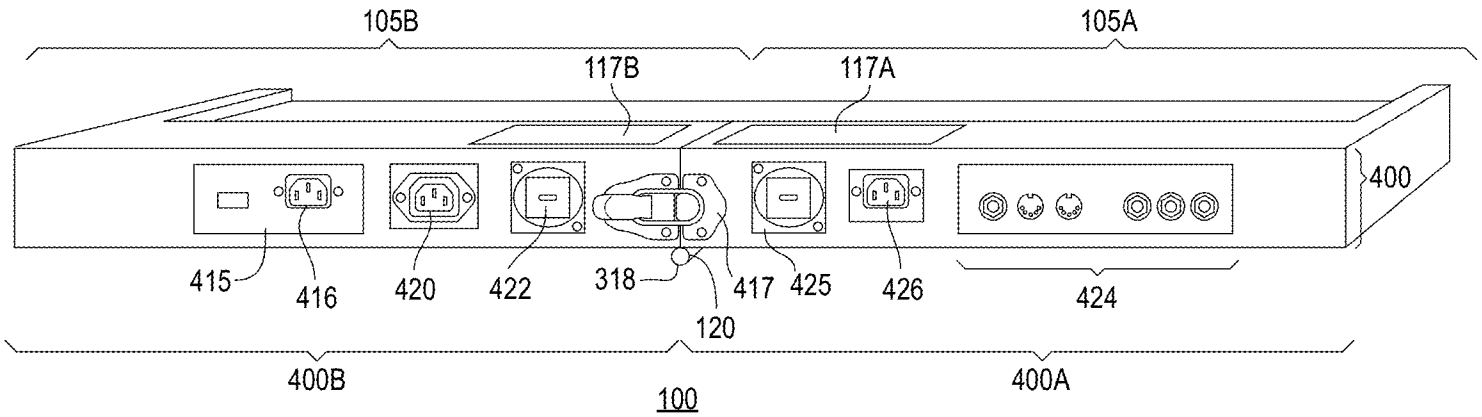
FIGS. 4A-4D are a set of four drawings depicting rear views of the folding keyboard showing sound-related and power-related connections.
Figure 4B:
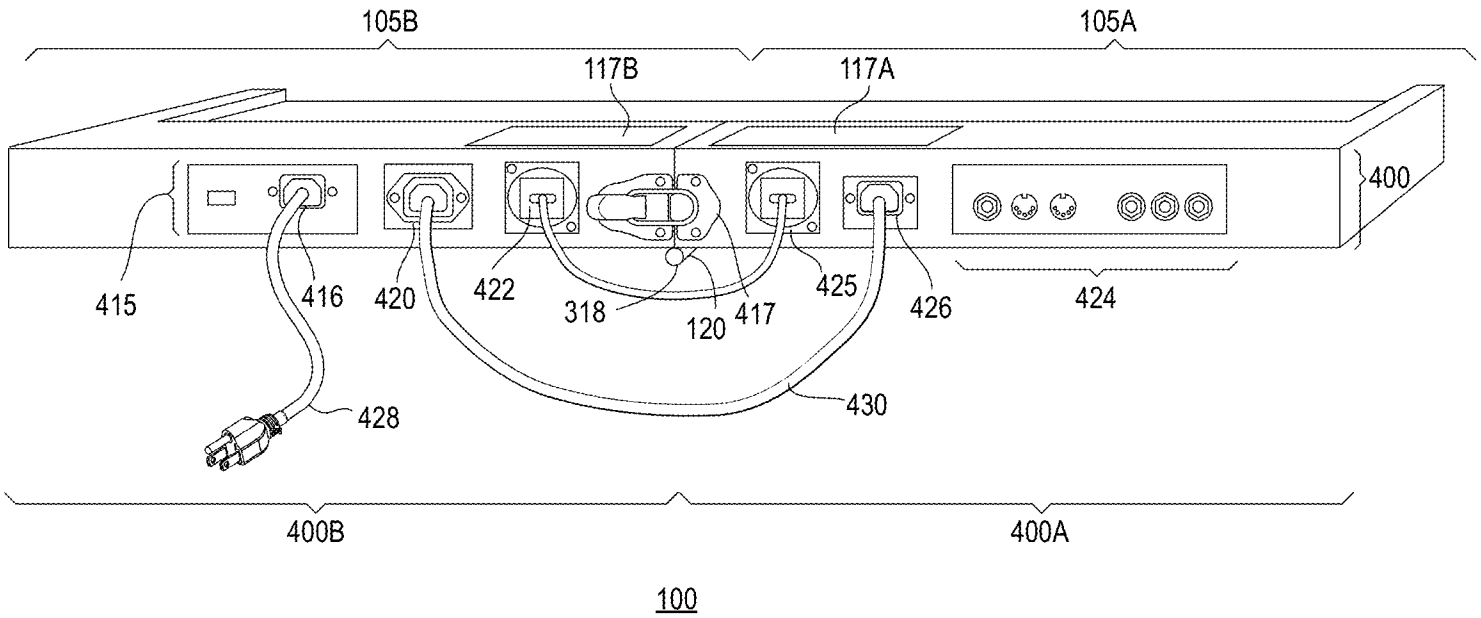

The first keyboard half 105A further comprises a first half hinge power connector 395, configured to transmit electrical power, after it is received from the wall power outlet (not shown) as shown in further detail in FIGS. 4A-4B, from the first keyboard half 105A to the second keyboard half 105B. The first half hinge power connector 395 is located immediately adjacent to the first hinge 120A. For example, and as depicted, the first half hinge power connector 395 comprises a male power connector 395. For example, and as depicted, the male power connector 395 comprises an International Electrotechnical Commission (IEC) 60320 c14 socket male connector 395, which is configured to connect to a cable with a female IEC 60320 c13 connector in the second keyboard half 105B.

The first keyboard half 105A further comprises a first half hinge electronic connector 396, configured to electrically connect the first keyboard half 105A to the second keyboard half 105B. The first half hinge electronic connector 396 is located immediately adjacent to the first hinge 120A. For example, and as depicted, the first half hinge electronic connector 396 comprises a female electronic connector 396. For example, and as depicted, the female electronic connector 396 comprises a female Universal Serial Bus-C (USB-C) port 396, which is configured to connect to a male USB-C port in the second keyboard half 105B.

The second keyboard half 105B further comprises a second half hinge power connector 397, which is configured to connect with the first half hinge power connector 395 to transmit the electrical power, after it is received from the wall power outlet (not shown) from the second keyboard half 105B to the first keyboard half 105A, as shown in further detail in FIGS. 4A-4B. For example, the second half hinge power connector 397 comprises a second half hinge power connector cable 397. The second half hinge power connector 397 is located immediately adjacent to the second hinge 120B. For example, and as depicted, the second half hinge power connector 397 comprises a female power connector 397. For example, and as depicted, the female first second half hinge power connector 397 comprises an IEC 60320 c13 socket female connector 420, which is configured to connect to the male IEC 60320 c14 socket 395 in the first keyboard half 105A.

The second keyboard half 105B further comprises a second half hinge electronic connector 398, which is configured to connect with the first half hinge electronic connector to electronically connect the second keyboard half 105B to the first keyboard half 105A. For example, the second half hinge electrical connector 398 comprises a second half hinge electrical connector cable 398. The electronic connector 398 is located immediately adjacent to the first keyboard hinge 120A. For example, and as depicted, the electronic connector 398 comprises a male electronic connector 398. For example, and as depicted, the male electronic connector 398 comprises a male USB-C port 398, which is configured to connect to the female USB-C port 396 in the first keyboard half 105A.

The second keyboard half 105B further comprises a connector compartment 399. The connector compartment 399 is configured to hold one or more of the first half hinge power connector 395, the first half hinge electronic connector 396, the second half hinge power connector 397, and the second half hinge electronic connector 398. Preferably, although not necessarily, and as depicted, the connector compartment 399 is configured to hold one or more of the female power connector 397 and the male electronic connector 398. Most preferably, although not necessarily, and as depicted, the connector compartment 399 is configured to hold the female power connector 397. Most preferably, although not necessarily, and as depicted, the connector compartment is further configured to hold the male electronic connector 398.

The mating of the male power connector 395 with the female power connector 397 transmits power between the first keyboard half 105A and the second keyboard half 105B.

The mating of the female electronic connector 396 with the male electronic connector 398 forms an electronic connection connecting the first keyboard half 105A to the second keyboard half 105B.

FIG. 3K is a detail drawing showing the detail box 310 depicted in FIGS. 3A and 3F according to this first supplemental or first alternative embodiment. FIG. 3K depicts a corollary drawing to FIG. 3F, showing the same view as is shown in FIG. 3F but for the first supplemental or first alternative embodiment. As with FIG. 3F, FIG. 3K depicts a fifth and final step in a five-step process according to this first supplemental or first alternative embodiment, of attaching the first keyboard half 105A and the second keyboard half 105B using the first keyboard half hinge (not shown in FIG. 3K; item 120A in FIG. 3J) and the second keyboard half hinge (not shown in FIG. 3K; item 120B in FIG. 3J), which together form the keyboard hinge 120.

As depicted in FIG. 3K, the first keyboard half 105A has again been moved (as in FIG. 3D) until it comes into contact with the second keyboard half 105B, and vice versa. The detail box 310 again comprises the first keyboard half 105A and the second keyboard half 105B, which are again being attached to each other, forming the keyboard hinge 120.

The first keyboard half 105A again further comprises the first half hinge power connector 395. The first half hinge power connector 395 is again located immediately adjacent to the first keyboard hinge 120A. For example, and as depicted, the first half hinge power connector 395 comprises a male power connector 395, which again is configured to connect the first keyboard half 105A to the second keyboard half 105B to transmit the electric power, after it is received from the wall power outlet (not shown) from the second keyboard half 105B to the first keyboard half 105A. For example, and as depicted, the male power connector 395 again comprises the IEC 60320 c14 socket male connector 420, which again is configured to connect to the female IEC 60320 c13 connector in the second keyboard half 105B.

The first keyboard half 105A again further comprises the first half hinge electronic connector 396, which is again configured to electronically connect the first keyboard half 105A to the second keyboard half 105B. The first half hinge electronic connector 396 is again located immediately adjacent to the first keyboard hinge 120A. For example, and as depicted, the first half hinge electronic connector 396 again comprises a female electronic connector 396. For example, and as depicted, the female electronic connector 396 again comprises the female USB-C port 396, which again is configured to connect to a male USB-C port in the second keyboard half 105B.

The second keyboard half 105B again further comprises the second half hinge power connector 397, which is again configured to connect with the first half hinge power connector 395 to transmit the electrical power, after it is received from the wall power outlet (not shown) from the second keyboard half 105B to the first keyboard half 105A. The second half hinge power connector 397 again is located immediately adjacent to the second keyboard hinge 120B. For example, and as depicted, the second half hinge power connector 397 again comprises the female power connector 397. For example, and as depicted, the female power connector 397 again comprises the IEC 60320 c13 female connector 420, which again is configured to connect to the male IEC 60320 c14 socket 395 in the first keyboard half 105A. The female power connector 397 is plugged into the male power connector 395 by the user (not shown) before setting up the keyboard 100 (not shown; shown in FIG. 1B).

The second keyboard half 105B again further comprises a second half hinge electronic connector 398, which is again configured to connect with the first half hinge electronic connector 396 to electronically connect the second keyboard half 105B to the first keyboard half 105A. The electronic connector 398 is located immediately adjacent to the first keyboard hinge 120A. For example, and as depicted, the electronic connector 398 comprises a male electronic connector 398. For example, and as depicted, the male electronic connector 398 comprises a male Universal Serial Bus-C (USB-C) port 398, which is configured to connect to the female USB-C port 396 in the first keyboard half 105A. The male electronic connector 398 is plugged into the female power connector 396 by the user (not shown) before setting up the keyboard 100 (not shown; shown in FIG. 1B).

The second keyboard half 105B further comprises a connector compartment 399. The connector compartment 399 is configured to hold one or more of the first half hinge power connector 395, the first half hinge electronic connector 396, the second half hinge power connector 397, and the second half hinge electronic connector 398. Preferably, and as depicted, the connector compartment 399 is configured to hold the first half hinge power connector 395, the first half hinge electronic connector 396, the second half hinge power connector 397, and the second half hinge electronic connector 398. The connector compartment 399 is further configured to hold the second half hinge power connector cable 397. The connector compartment is further configured to hold the second half hinge electronic connector cable 398.

The mating of the male power connector 395 with the female power connector 397 transmits power between the first keyboard half 105A and the second keyboard half 105B.

The mating of the female electronic connector 396 with the male electronic connector 398 forms an electronic connection connecting the first keyboard half 105A to the second keyboard half 105B.

Figure 3L:
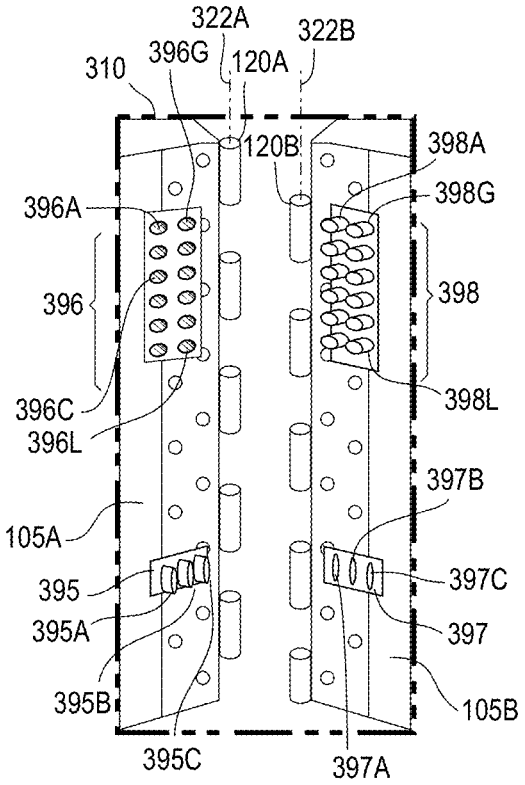
Figure 3M:
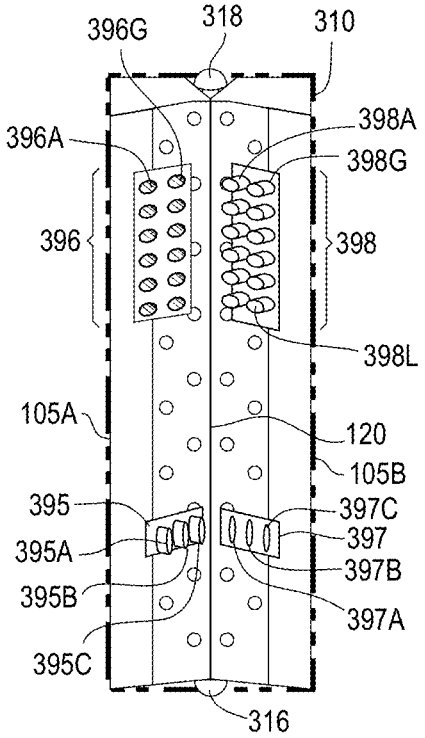

FIGS. 3L-3M are a pair of drawings that depict one or more of a second alternative embodiment and a second supplemental embodiment to the system depicted in detail in FIGS. 3B-3F and 3J-3K for attaching the first keyboard half 105A and the second keyboard half 105B using the first keyboard half hinge 120A and the second keyboard half hinge 120B, which together form the keyboard hinge (not shown in FIGS. 3B-3C nor in FIG. 3J; item 120 in FIGS. 3F and 3K). As depicted in FIGS. 3L-3M, the second keyboard half 105B comprises a male connector located immediately adjacent to the hinge, and the first keyboard half 105A comprises a female connector located immediately adjacent to the hinge in a symmetrically opposed position.

FIG. 3L is a detail drawing showing the detail box 310 depicted in FIGS. 3A, 3B and 3J according to this second supplemental or second alternative embodiment. FIG. 3L depicts a corollary drawing to FIGS. 3B and 3J, showing the same view as is shown in FIGS. 3B and 3J but for the second supplemental or second alternative embodiment. As with FIGS. 3B and 3J, FIG. 3L depicts a first step in a five-step process, according to this second supplemental or second alternative embodiment, of attaching the first keyboard half 105A and the second keyboard half 105B using the first keyboard half hinge 120A and the second keyboard half hinge 120B, which together will form the keyboard hinge (not shown in FIG. 3L; item 120 in FIGS. 3F, 3K and 3M).

According to this example, the hinge (not shown in FIG. 3L; item 120 in FIGS. 3F, 3K and 3M) again comprises a hinge (not shown in FIG. 3L; item 120 in FIGS. 3F, 3K and 3M) to be formed from the first keyboard half hinge 120A and the second keyboard half hinge 120B, the hinge again comprising an interface (not shown in FIG. 3L; item 120 in FIGS. 3F, 3K and 3M) configured to facilitate transmission between the keyboard halves 105A, 105B of one or more of power and electronic signals. For example, the electronic signals comprise audio signals.

The detail box 310 again comprises the first keyboard half 105A and the second keyboard half 105B, which are again being attached to each other using the first keyboard half hinge 120A and the second keyboard half hinge 120B, which together will form the keyboard hinge (not shown in FIGS. 3B-3C, 3J, and 3L; item 120 in FIGS. 3F, 3K and 3M).

As depicted in FIG. 3L, the first keyboard half 105A is again fully separated from the second keyboard half 105B, and vice versa, meaning also that the first keyboard half hinge 120A is again fully disengaged from the second keyboard half hinge 120B and vice versa.

The first keyboard half hinge 120A again comprises the first keyboard half hinge axis 322A, and the second keyboard half hinge 120B again comprises the second keyboard half hinge axis 322B. Currently, as shown in FIG. 3L, the first keyboard half hinge axis 322A is not aligned with the second keyboard half hinge axis 322B.

The first keyboard half 105A again further comprises the first half hinge power connector 395, which is again configured to transmit electrical power, after it is received from the wall power outlet (not shown) as shown in further detail in FIGS. 4A-4B, from the second keyboard half 105B to the first keyboard half 105A. The first half hinge power connector 395 is again located immediately adjacent to the first keyboard hinge 120A. For example, and as depicted, the first half hinge power connector 395 again comprises the male power connector 395.

For example, and as depicted, the male power connector 395 comprises a male power connector cylinder set 395. For example, the male power connector cylinder set 395 comprises a plurality of male power connector cylinders 395A-395C. As depicted, the male power connector cylinder set 395 comprises three male power cylinders 395A-395C. For example, at least one of the male power connector cylinders 395A-395C is spring-loaded. Preferably, but not necessarily, each of the male power connector cylinders 395A-395C is spring-loaded.

The first keyboard half 105A again further comprises the first half hinge electronic connector 396, which is again configured to electronically connect the first keyboard half 105A to the second keyboard half 105B. The first half hinge electronic connector 396 is again located immediately adjacent to the first keyboard hinge 120A. For example, and as depicted, the first half hinge electronic connector 396 again comprises the female electronic connector 396.

For example, the female electronic connector 396 comprises a female electronic connector contact set 396. For example, the female electronic connector contact set 396 comprises a plurality of female electronic connector contacts 396A-396L. As depicted, the female electronic connector contact set 396 comprises twelve female electronic connector contacts 396A-396L. For example, at least one of the female electronic connector contacts 396A-396L comprises one or more of gold, silver, copper, platinum, and another metal with excellent electrical conductivity. For example, each of the female electronic connector contacts 396A-396L comprise female gold contacts 396A-396L.

The second keyboard half 105B again further comprises the second half hinge power connector 397, which is configured to connect with the first half hinge power connector 395 to transmit the electrical power, after it is received from the wall power outlet (not shown) from the second keyboard half 105B to the first keyboard half 105A, as shown in further detail in FIGS. 4A-4B. The second half hinge power connector 397 is again located immediately adjacent to the second keyboard hinge 120B. For example, and as depicted, the second half hinge power connector 397 comprises a set of female power contacts 397.

For example, and as depicted, the female power connector 397 comprises a female power connector contact set 397. For example, the female power connector contact set 397 comprises a plurality of female power connector contacts 397A-397C. As depicted, the female power connector contact set 397 comprises three female power contacts 397A-397C. For example, at least one of the female power connector contacts 397A-397C comprises one or more of gold, silver, copper, platinum, and another metal with excellent electrical conductivity. For example, each of the female power connector contacts 397A-397C comprises female power gold contacts 397A-397C.

The second keyboard half 105B again further comprises the second half hinge electronic connector 398, which is again configured to connect with the first half hinge electronic connector to electronically connect the second keyboard half 105B to the first keyboard half 105A. The electronic connector 398 is again located immediately adjacent to the first keyboard hinge 120A. For example, and as depicted, the electronic connector 398 again comprises the male electronic connector 398.

For example, and as depicted, the male electronic connector 398 comprises a male electronic connector cylinder set 398. For example, the male electronic connector cylinder set 398 comprises a plurality of male electronic connector cylinders 398A-398L. As depicted, the male electronic connector cylinder set 398 comprises twelve male power cylinders 398A-398L. For example, at least one of the male electronic connector cylinders 398A-398L is spring-loaded. Preferably, but not necessarily, each of the male electronic connector cylinders 398A-398L is spring-loaded.

The mating of the male power connector 395 with the female power connector 397 again transmits power from the second keyboard half 105B to the first keyboard half 105A.

The mating of the female electronic connector 396 with the male electronic connector 398 again forms an electronic connection connecting the first keyboard half 105A and the second keyboard half 105B.

In this example, the mating of the male power connector 395 with the female power connector 397 happens automatically upon closing the hinge 120 (not shown in FIG. 3L; item 120 in FIG. 3M). In this example, the mating of the female electronic connector 396 with the male electronic connector 398 happens automatically upon closing the hinge 120 (not shown in FIG. 3L; item 120 in FIG. 3M).

FIG. 3M is a detail drawing showing the detail box 310 depicted in FIGS. 3A and 3F according to this second supplemental or second alternative embodiment. FIG. 3M depicts a corollary drawing to FIG. 3L, showing the same view as is shown in FIG. 3L but for the second supplemental or second alternative embodiment. As with FIG. 3F, FIG. 3M depicts a fifth and final step in a five-step process according to this second supplemental or second alternative embodiment, of attaching the first keyboard half 105A and the second keyboard half 105B using the first keyboard half hinge (not shown in FIG. 3M; item 120A in FIG. 3L) and the second keyboard half hinge (not shown in FIG. 3M; item 120B in FIG. 3L), which together form the hinge 120.

As depicted in FIG. 3M, the first keyboard half 105A has again been moved (as in FIG. 3D) until it comes into contact with the second keyboard half 105B, and vice versa. The detail box 310 again comprises the first keyboard half 105A and the second keyboard half 105B, which are again being attached to each other, thereby forming the hinge 120.

The first keyboard half 105A again further comprises the first half hinge power connector 395. The first half hinge power connector 395 is again located immediately adjacent to the first keyboard hinge 120A. For example, and as depicted, the first half hinge power connector 395 comprises a male power connector 395, which again is configured to connect the first keyboard half 105A to the second keyboard half 105B to transmit the electric power, after it is received from the wall power outlet (not shown) from the second keyboard half 105B to the first keyboard half 105A.

For example, and as depicted, the male power connector 395 again comprises the male power connector cylinder set 395. For example, the male power connector cylinder set 395 again comprises the plurality of male power connector cylinders 395A-395C. As depicted, the male power connector cylinder set 395 again comprises three male power cylinders 395A-395C. For example, at least one of the male power connector cylinders 395A-395C is spring-loaded. Preferably, but not necessarily, each of the male power connector cylinders 395A-395C is spring-loaded.

The first keyboard half 105A again further comprises the first half hinge electronic connector 396, which is again configured to electronically connect the first keyboard half 105A to the second keyboard half 105B. The first half hinge electronic connector 396 is again located immediately adjacent to the first keyboard hinge (not shown in FIG. 3M; item 120A in FIG. 3L). For example, and as depicted, the first half hinge electronic connector 396 again comprises the female electronic connector 396.

For example, the female electronic connector 396 again comprises the female electronic connector contact set 396. For example, the female electronic connector contact set 396 again comprises the plurality of female electronic connector contacts 396A-396L. As depicted, the female electronic connector contactor set 396 again comprises the twelve female electronic connector contacts 396A-396L. For example, at least one of the female electronic connector contacts 396A-396L again comprises the female electronic gold contacts 396A-396L, the female electronic gold contacts 396A-396L comprising one or more of gold, silver, copper, platinum, and another metal with excellent electrical conductivity. Preferably, but not necessarily, each of the female power connector cylinders 396A-396L again comprises the female electronic gold contacts 396A-396L.

The second keyboard half 105B again further comprises the second half hinge power connector 397, which is again configured to connect with the first half hinge power connector 395 to transmit the electrical power, after it is received from the wall power outlet (not shown) from the second keyboard half 105B to the first keyboard half 105A. The second half hinge power connector 397 again is located immediately adjacent to the second keyboard hinge (not shown in FIG. 3M; item 120B in FIG. 3L). For example, and as depicted, the second half hinge power connector 397 again comprises the female power connector 397.

For example, and as depicted, the female power connector 397 again comprises the female power connector contact set 397. For example, the female power connector contact set 397 again comprises the plurality of female power connector contacts 397A-397C. As depicted, the female power connector contact set 397 again comprises three female power contacts 397A-397C. For example, at least one of the female power connector contacts 397A-397C comprises one or more of gold, silver, copper, platinum, and another metal with excellent electrical conductivity. Preferably, but not necessarily, each of the female power connector contacts 397A-397C comprises female power gold contacts 397A-397C.

The second keyboard half 105B again further comprises a second half hinge electronic connector 398, which is again configured to connect with the first half hinge electronic connector 396 to electronically connect the second keyboard half 105B to the first keyboard half 105A. The electronic connector 398 is again located immediately adjacent to the second half keyboard hinge (not shown in FIG. 3M; item 120B in FIG. 3L). For example, and as depicted, the electronic connector 398 again comprises a male electronic connector 398.

For example, and as depicted, the male electronic connector 398 again comprises the male electronic connector cylinder set 398. For example, the male electronic connector cylinder set 398 again comprises the plurality of male electronic connector cylinders 398A-398L. As depicted, the male electronic connector cylinder set 398 again comprises twelve male power cylinders 398A-398L. For example, at least one of the male electronic connector cylinders 398A-398L is again spring-loaded. Preferably, but not necessarily, each of the male electronic connector cylinders 398A-398L is again spring-loaded.

The mating of the male power connector 395 with the female power connector 397 again transmits power between the first keyboard half 105A and the second keyboard half 105B.

The mating of the female electronic connector 396 with the male electronic connector 398 again forms an electronic connection connecting the first keyboard half 105A to the second keyboard half 105B.

In this example, the mating of the male power connector 395 with the female power connector 397 again happens automatically upon closing the keyboard hinge 120. In this example, the mating of the female electronic connector 396 with the male electronic connector 398 happens automatically upon closing the keyboard hinge 120.

FIGS. 4A-4D are a set of four drawings depicting rear views of the folding keyboard showing sound-related and power-related connections.

FIG. 4A is a drawing depicting a rear panel 400 of the keyboard 100. The keyboard 100 again comprises the first keyboard half 105A, the second keyboard half 105B, first sound control section 117A, the second sound control section 117B, and the second pin 317 which has been inserted into the hinge 120 until only the second pinhead 318 is shown. (The first pin is not visible in this figure; it is item 315 in FIGS. 3A and 3C-3E)

The rear panel 400 comprises a first rear panel half 400A that is comprised in the first half keyboard 105A. The rear panel 400 further comprises a second rear panel half 400B that is comprised in the second half keyboard 105B.

The second rear panel 400B further comprises a power-related connections panel 415, the power-related connections panel 415 comprising one or more connections relating to powering the keyboard 100. As discussed in further detail in FIG. 4D below, the power-related connections panel 415 comprises an alternating current (AC) power connector 416. For example, the AC power connector 416 is configured to create a usable AC power connection to a power cord of the type used with computers and the like. For example, and as depicted, the AC power connector 416 comprises a type International Electrotechnical Commission (IEC) 60320 c14 socket male connector 416, which is configured to connect to wall outlet power (not shown) using a cable having an IEC 60320 c13 female socket connector.

The keyboard 100 further comprises an optional latch 417. For example, and as depicted, the rear panel 400 comprises the latch 417. The latch 417 comprises a heavy-duty latch 417. As depicted, and for example, but not necessarily, the rear panel 400 comprises the latch 417. The latch 417 is configured to provided further strength to hold together the first keyboard half 105A and the second keyboard half 105B. The latch 417 keeps the keyboard 100 from rotating about the axis formed by the hinge 120. Under normal operation, when placed on a level surface for use, the sides of the keyboard halves 105A, 105B, in conjunction with gravity, will in any event normally help keep the keyboard 100 fixed in place without rotating about the hinge 120.

The second rear panel 400B further comprises a second half power connector 420, usable to transmit the electrical power, after it is received from the wall power outlet (not shown) through the AC power connector 416 by the second keyboard half 105B, from the second keyboard half 105B to the first keyboard half 105A. For example, and as depicted, the second half power connector 420 comprises a female second half power connector socket 420. For example, and as depicted, the female second half power connector socket 420 comprises an IEC 60320 c13 socket female connector 420, which is configured to connect to a cable having a male IEC 60320 c14 socket connector. The second rear panel 400B comprises connections that are not needed for either of the two alternative embodiments depicted in FIGS. 3J-3M.

The second rear panel 400B further comprises a second keyboard half connector 422, usable to electronically connect the second keyboard half 105B to the first keyboard half 105A. For example, the second female keyboard half connector 422 comprises a female keyboard half connector socket 422. For example, and as depicted, the second female keyboard half connector socket 422 comprises a female USB-C port 422, which is configured to connect to the first keyboard half 105A via a cable having two male USB-C ports, one at each end of the cable (not shown).

The first rear panel 400A comprises a sound-related connections panel 424, the sound-related connections panel 424 comprising one or more connections relating to sound of the keyboard 100. As discussed in further detail in FIG. 4C below, the sound-related connections panel 424 comprises connections associated with sound-related electronic signals.

The first rear panel 400A further comprises a first keyboard half connector 425, usable to electronically connect the first keyboard half 105A to the second keyboard half 105B. For example, the first female keyboard half connector 425 comprises a female keyboard half connector socket 425. For example, and as depicted, the first female keyboard half connector socket 425 comprises a female USB-C port 425, which is configured to connect to the second keyboard half 105B by connecting to the second keyboard half connector 422 via a cable having two male USB-C ports, as depicted in further detail in FIG. 4B.

The first rear panel 400A further comprises a first half power connector 426, usable to transmit power between the first keyboard half 105A and the second keyboard half 105B. For example, the first half power connector 426 comprises a male first half power connector socket 426. For example, and as depicted, the male first half power connector socket 426 comprises an IEC 60320 c14 socket male connector 426, which is configured to connect to a cable having a female IEC 60320 c13 connector. As shown in FIG. 4B below, for example, and as depicted, a cable with one end comprising a male EC 60320 c14 connector is connected to the female first half power connector socket 420 and the other end of the cable comprising a female EC 60320 c13 connector connected to the male second half power connector socket 426, thereby electrically connecting the keyboard halves 105A, 105B.

FIG. 4B is a drawing depicting a rear view of the keyboard 100. The keyboard 100 again comprises the first keyboard half 105A, the second keyboard half 105B, the first sound control section 117A, the second sound control section 117B, and the second pin 317, which has again been inserted into the hinge 120 until only the second pinhead 318 is visible. (The first pin is again not visible in this figure.)

The rear panel 400 again comprises the first rear panel half 400A and the second rear panel half 400B. The second rear panel 400B again further comprises the power-related connections panel 415, which, as discussed in further detail in FIG. 4D below, again comprises the AC power connector 416. An AC power cable 428 connects the AC power connector 416 to wall outlet power (not shown). For example, and as depicted, the AC power cable 428 comprises an IEC 60320 c13 female socket at one end and at the other end, a plug configured to connect to wall outlet power (not shown).

The rear panel 400 again further comprises the latch 417. The first rear panel 400A again further comprises the sound-related connections panel 424.

The second rear panel 400B again further comprises the second half power connector 420. The first rear panel 400A again further comprises the first half power connector 426. The second half power connector 420 and the first half power connector 426 are connected to each other using a power connector cable 430. For example, and as depicted, the power connector cable 430 comprises a male-to-female IEC 60320 c14 (male) connector to IEC 60320 c13 (female) connector.

The second rear panel 400B again further comprises the second keyboard half connector 422. The first rear panel 400A again further comprises the first keyboard half connector 425. The second keyboard half connector 422 and the first keyboard half connector 425 are connected to each other using a keyboard half connector cable 432. For example, and as depicted, the keyboard half connector cable 432 comprises a male-to-male USB-C cable.

Figure 4D:
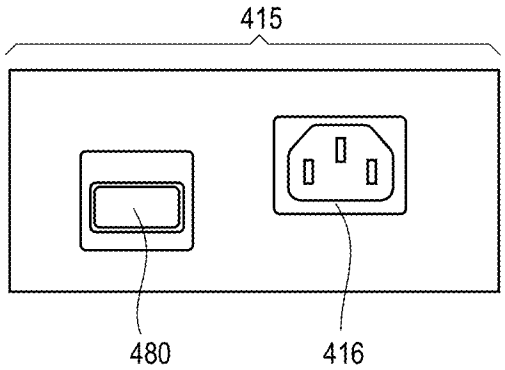
Figure 4C:
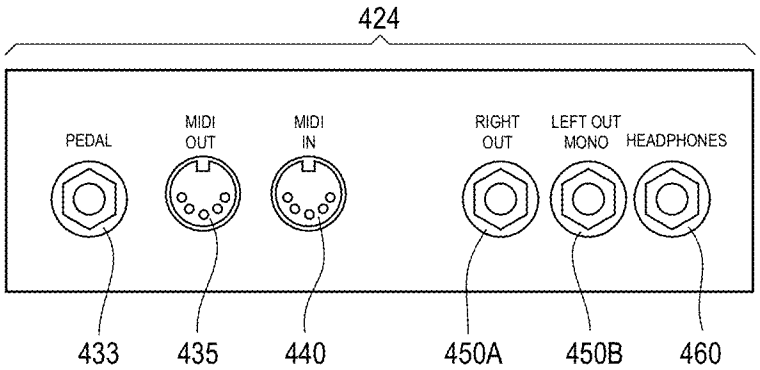

FIG. 4C is a drawing depicting a rear view of the sound-related connections panel 424. For example, in this particular embodiment, the sound-related connections panel 424 is shown as seen looking at the first keyboard half (not shown in this figure; item 105A in FIG. 1A) from the rear. As depicted, the sound-related connections panel 424 comprises a pedal input port 433 configured to receive input from a pedal. As one example, the pedal input port 433 is configured to receive input from the pedal console (not shown in this figure; item 140 in FIG. 1A-1B). As depicted, the sound-related connections panel 424 further comprises a Musical Instrument Digital Interface (MIDI) output port 435. As depicted, the sound-related connections panel 424 further comprises a MIDI input port 440. As depicted, the sound-related connections panel 424 further comprises a right mixer output port 450A and a left mixer output port 450B. For example, one or more of the right mixer output port 450A and the left mixer output port 450B comprises a ¼-inch output suitable for use with a mixing board. As depicted, the sound-related connections panel 424 further comprises a headphone output 460 suitable for use configured to provide output suitable for use with headphones.

FIG. 4D is a drawing depicting a rear view of the power-related connections panel 415. For example, in this particular embodiment, the power-related connections panel 415 is shown as seen looking at the second keyboard half (not shown in this figure; item 105B in FIG. 1A) from the rear. As depicted, the power-related connections panel 415 comprises a power on/off switch 480 usable to turn power to the keyboard 100 on or off as desired. As depicted, the power-related connections panel 415 further comprises an alternating current (AC) power connector 416. For example, the AC power connector 416 is configured to create a usable AC power connection to a power cord of the type used with computers and the like. For example, the AC power connector 416 comprises a type International Electrotechnical Commission (IEC) 60320 c14 socket male connector 416, which is configured to connect to wall outlet power (not shown) using a cable having an IEC 60320 c14 female socket.

When using the keyboard, additional equipment that may be useful comprises one or more of an amplifier, a microphone and a keyboard stand. The keyboard's mixer can be designed to receive other inputs. Accordingly, one or more of additional microphones and additional instruments can be added and fed through the amplifier.

Additional options that can easily be added to the keyboard according to embodiments of the invention include one or more of: a disc jockey (DJ) control section, a lighting control section, an interface to a computer, a special output monitor for music editing software that can be taken on the road, and a transmitter section that will support silent disco-style controls.

According to further embodiments of the invention, the keyboard comprises a power source. For example, the power source comprises an internal battery configured to support up to several hours of playing between charges without a need for external power.

The cabling between the keyboard, mixer, and other instruments can optionally be integrated into a single unit.

As shown in FIG. 1A, each side would be supported independently with four legs, and then could be slid together and connected for playing. At that point, the four middle legs could be folded up or removed, so that there would be no obstruction in the middle.

Embodiments of the invention will be available in a number of different configurations. Once assembled, the keyboard would be a full 88-key keyboard, but will use 6-inch octaves. Alternatively, or additionally, the foldable keyboard includes functionality typically not coupled within a standard analog piano keyboard. For example, the keyboard includes functionality such as one or more of a mixer, microphone inputs, and a wireless microphone option.

Advantages of embodiments of the invention include its ability to break into two sections, thereby making it lighter and easier to move and store. A further advantage of embodiments of the invention is that the full weight of the keyboard does not need to be lifted at once. Accordingly, a person who can lift less weight can still set-up the keyboard quite easily.

Further advantage of embodiments of the invention include that for travelling musicians, the embodiments of the invention can do one or more of reduce set-up time and enhance mobility. Additional advantages of embodiments of the invention are that fewer pieces of equipment may be required by musicians using embodiments of the invention. For example, only an amplifier may be needed. For example, embodiments of the invention may help eliminate or reduce a musician's need for a mixer for one or more of keyboard inputs and microphone inputs. Further advantages of embodiments of the invention include that embodiments of the invention may help eliminate or reduce a musician's need for a separate sound effects section to generate one or more of reverb, a chorus, and a preset for a particular performance space. Yet further advantages of embodiments of the invention include that embodiments of the invention can generate one or more of a piano sound and a synthesizer sound.

Embodiments of the invention have the additional advantage that they can be shipped easily on an airplane. Moreover, embodiments of the invention are, much less bulky than prior art keyboards. Embodiments of the invention fit into the passenger area within an average car and will fit into an average trunk. Each half of the modular keyboard is lighter in weight. Additionally, since each section is both shorter and lighter in weight, it can be lifted and moved quite easily by even shorter statured persons, or those who have a problem lifting heavy objects. A further advantage is that the two modular halves of the keyboard can be folded together to create a consolidated single keyboard unit for more convenient storage and/or transport. This configuration can fit within a typical car trunk or can be checked in as luggage for airline transport.

Embodiments of the invention reduce set-up time and improve mobility by requiring fewer pieces of equipment. For example, only the keyboard and an amplifier may be required.

Embodiments of the invention offer a 6" (15.25 cm) octave that is easier for many women and children and men of smaller stature. According to further embodiments of the invention, the 5.5" (14 cm) offers similar, and potentially even greater, advantages. Further embodiments of the invention offer all these advantages while also providing weighted keys configured to offer the user natural "feel" or "touch" that is similar to, but not identical with, a standard acoustic piano such as one or more of an upright piano and grand piano.

In contrast to the prior art, embodiments of the invention do not require other electronic units in order to be heard (e.g., mixer, effects, amplifier), and moreover, reduced setup is thereby required to operate embodiments of the invention. Embodiments of the invention eliminate a need for one or more of external cables to interconnect these components and the room needed to assemble them. Instead embodiments of the invention integrate into a single unit cabling between 1) the keyboard and 2) one or more of a mixer and another instrument.

Embodiments of the invention achieve all these advantages without the disadvantages of existing prior art keyboards comprising a reduced set of keys, for example, 61 keys rather than a standard 88 keys. Embodiments of the invention comprising a two-section keyboard design provide users not only with the ease of moving and set-up, but also with the full range of notes available on a standard piano.

For example, it will be understood by those skilled in the art that software used by the keyboard may be located in any location in which it may be accessed by the device. It will be further understood by those of skill in the art that the number of variations of the device are virtually limitless. It is intended, therefore, that the subject matter in the above description shall be interpreted as illustrative and shall not be interpreted in a limiting sense.

For example, there might be more than two keyboard sections. For example, a different kind of junction not comprising a hinge can be used to join the keyboard sections.

For example, the keyboard could have a different configuration of the sound controls. For example, the keyboard could have a different configuration of the power controls. Some of the sound controls currently depicted in the first keyboard half could be in the second keyboard half and vice versa. Some or all of the power controls currently depicted in the first keyboard half could be in the second keyboard half and vice versa. For example, the keyboard could use a different electrical plug. For example, the keyboard could be exclusively battery powered. For example, one or more of the removable pins could be located elsewhere in the keyboard other than in the junction. The keyboard could comprise more than two sections. The different controls could be allocated differently between the sections. The keyboard could not comprise a pedal. The keyboard could comprise a music stand suitable to hold sheet music.

For example, male and female power connectors might be located in different sections of the keyboard than depicted here. For example, male and female electronic connectors might be located in different sections of the keyboard than depicted here. For example, the power connectors might have a structure not using male and female power connectors. For example, the electronic connectors might have a structure not using male and female electronic connectors.

For example, instead of comprising removable legs that are removed from the piano when in use, the removable legs are folded conveniently out sight when not needed. For example, a different method for holding the keyboard halves together from one or more of the depicted interlocking junction and the pin could be used while still remaining within the scope of the invention. For example, the pin could be inserted into the keyboard junction from the back side of the foldable keyboard instead of from the front side. For example, the keyboard is configured to mate the male power connector with the female power connector upon closing of the hinge. For example, the keyboard is configured to mate the male electronic connector with the female electronic connector upon closing of the hinge. Countless other variations are available while remaining within the scope of the invention.

While the above representative embodiments have been described with certain components in exemplary configurations, it will be understood by one of ordinary skill in the art that other representative embodiments can be implemented using different configurations and/or different components. For example, it will be understood by one of ordinary skill in the art that the order of certain steps and certain components can be altered without substantially impairing the functioning of the invention.

The representative embodiments and disclosed subject matter, which have been described in detail herein, have been presented by way of example and illustration and not by way of limitation. It will be understood by those skilled in the art that various changes may be made in the form and details of the described embodiments resulting in equivalent embodiments that remain within the scope of the invention. It is intended, therefore, that the subject matter in the above description shall be interpreted as illustrative and shall not be interpreted in a limiting sense.

What is claimed is:

1. A portable piano keyboard configured to be separable into two keyboard halves, each keyboard half comprising approximately half the total number of keys in the keyboard, the two keyboard halves having approximately equal lengths, the two keyboard halves being foldable together to create a consolidated single unit, the keyboard having a smaller keyboard length relative to a standard 6.5-inch octave, the keyboard comprises a standard 88 keys, wherein the keyboard is foldable along a keyboard hinge, the hinge comprising an interface configured to facilitate transmission between the keyboard halves of one or more of power and electronic signals, the hinge further comprising a removable pin configured to keep the two keyboard halves together, wherein removal of the removable pin permits the two keyboard halves to be separated, wherein a first keyboard half comprises a male power connector located immediately adjacent to the hinge, the first keyboard half further comprising a female electronic connector located immediately adjacent to the hinge, wherein the male power connector and the female power connector are configured to transmit power between the keyboard halves, and wherein the second keyboard half comprises a female power connector located immediately adjacent to the hinge in a position symmetrically opposed to the male power connector, the second keyboard half further comprising a male electronic connector located immediately adjacent to the hinge in a position symmetrically opposed to the female electronic connector, wherein the male electronic connector and the female electronic connector are configured to transmit electronic signals between the keyboard halves, the hinge further comprising a connector compartment configured to hold one or more of the male power connector, the female power connector, the male electronic connector, and the female electronic connector.

2. A portable piano keyboard configured to be separable into two keyboard halves, each keyboard half comprising approximately half the total number of keys in the keyboard, the two keyboard halves having approximately equal lengths, the two keyboard halves being foldable together to create a consolidated single unit, the keyboard having a smaller keyboard length relative to a standard 6.5-inch octave, the keyboard comprises a standard 88 keys, wherein the keyboard is foldable along a keyboard hinge, the hinge comprising an interface configured to facilitate transmission between the keyboard halves of one or more of power and electronic signals, the hinge further comprising a removable pin configured to keep the two keyboard halves together, wherein removal of the removable pin permits the two keyboard halves to be separated, wherein a first keyboard half comprises a male power connector located immediately adjacent to the hinge, the first keyboard half further comprising a female electronic connector located immediately adjacent to the hinge, wherein the male power connector and the female power connector are configured to transmit power between the keyboard halves, and wherein the second keyboard half comprises a female power connector located immediately adjacent to the hinge in a position symmetrically opposed to the male power connector, the second keyboard half further comprising a male electronic connector located immediately adjacent to the hinge in a position symmetrically opposed to the female electronic connector, wherein the male electronic connector and the female electronic connector are configured to transmit electronic signals between the keyboard halves, the male power connector automatically mating with the female power connector upon closing the hinge, the female electronic connector automatically mating with the male electronic connector upon closing the hinge.

* * * * *